US009318228B2

(12) United States Patent
Gentile et al.

(10) Patent No.: US 9,318,228 B2
(45) Date of Patent: Apr. 19, 2016

(54) PRODUCTION OF RADIONUCLIDE MOLYBDENUM 99 IN A DISTRIBUTED AND IN SITU FASHION

(76) Inventors: Charles A. Gentile, Plainsboro, NJ (US); Adam B. Cohen, Princeton Junction, NJ (US); George Ascione, Cream Ridge, NJ (US)

( * ) Notice: Subject to any disclaimer, the term of this patent is extended or adjusted under 35 U.S.C. 154(b) by 401 days.

(21) Appl. No.: 13/457,174

(22) Filed: Apr. 26, 2012

(65) Prior Publication Data

US 2012/0275557 A1 Nov. 1, 2012

Related U.S. Application Data

(60) Provisional application No. 61/479,278, filed on Apr. 26, 2011.

(51) Int. Cl.

| | |
|---|---|
| ***G21G 1/12*** | (2006.01) |
| ***G21G 4/02*** | (2006.01) |
| *G21G 1/00* | (2006.01) |

(52) U.S. Cl.

CPC .. *G21G 4/02* (2013.01); *G21G 1/12* (2013.01); *G21G 2001/0036* (2013.01)

(58) Field of Classification Search

CPC ..... G21G 2001/0036; G21G 2001/0042; G21G 1/12; G21G 1/06

USPC ..... 376/157, 186

See application file for complete search history.

(56) References Cited

U.S. PATENT DOCUMENTS

| | | | | |
|---|---|---|---|---|
| 2,279,023 | A * | 4/1942 | Hartmut et al. | 376/158 |
| 5,784,423 | A * | 7/1998 | Lidsky et al. | 376/156 |
| 5,802,438 | A * | 9/1998 | Bennett et al. | 423/2 |
| 7,622,709 | B2 * | 11/2009 | Zillmer et al. | 250/251 |
| 2011/0268237 | A1 * | 11/2011 | Holden et al. | 376/108 |

OTHER PUBLICATIONS

Scherrer, et al., "Gamma Rays from Interaction of 14-MeV Neutrons with Various Materials" Phys. Rev. 1953, 91(6), pp. 1476-1478.*

Nuclear and Radiation Studies Board, "Medical Isotopes Production without Highly Enriched Uranium." Washington D. C.; National Academies, 2009 Web. Jun. 28, 2011.

* cited by examiner

*Primary Examiner* — Jack W Keith
*Assistant Examiner* — Sharon M Davis
(74) *Attorney, Agent, or Firm* — Meagher Emanuel Laks Goldberg & Liao, LLP

(57) ABSTRACT

A method and apparatus for producing Mo-99 from Mo-100 for the use of the produced Mo-99 in a Tc-99m generator without the use of uranium is presented. Both the method and apparatus employ high energy gamma rays for the transformation of Mo-100 to Mo-99. The high energy gamma rays are produced by exposing a metal target to a moderated neutron output of between 6 MeV and 14 MeV. The resulting Mo-99 spontaneously decays into Tc-99m and can therefore be used in a Tc-99m generator.

6 Claims, 22 Drawing Sheets

PRODUCTION OF RADIONUCLIDE MOLYBDENUM 99 IN A DISTRIBUTED AND IN SITU FASHION

CROSS-REFERENCE TO PRIOR FILED APPLICATION

This application claims priority to an earlier filed provisional application 61/479,278 filed on Apr. 26, 2011, which is herein incorporated by reference in its entirety.

UNITED STATES GOVERNMENT RIGHTS

This invention was made with government support under Department of Energy Contract DEAC02-09CH 11466. The government has certain rights in this invention.

FIELD OF THE DISCLOSURE

The present disclosure generally relates to producing high energy gamma rays which can be employed to produce Molybdenum 99. Molybdenum 99 decays to Technetium-99m, a radioactive tracer isotope used for diagnostic imaging. The present disclosure also relates to producing Molybdenum 99 using neutrons and gamma rays from a variety of sources. The present disclosure further relates to producing Molybdenum 99 using naturally occurring Molybdenum-100, on demand and in ample quantities to support daily needs and without fission by-products.

BACKGROUND

Molybdenum 99 (Mo-99) is a man-made radionuclide which decays ($T_{1/2}$=66 hours) to Technetium-99m (Tc-99m). Tc-99m is a radioactive tracer isotope, frequently used in the nuclear medical field for diagnostic imaging. In the United States alone, it is used in about ⅔ of all diagnostic medical isotope procedures.

The use of Tc-99m in particular is beneficial for various reasons. Most importantly, it has a relatively short half-life of about 6 hours. This is especially ideal in medical diagnostic tests where the patient only retains a minimal amount of radiation from the examination while the radiologist is still able to attain thorough results quickly and efficiently. The metastable state of Tc-99m also ensures that the element will not transform into any other substance due to its own decay. Although, Tc-99 the decay product of Tc-99m is slightly unstable and can decay into ruthenium-99 and a weak beta particle, Tc-99 has a long half-life ($T_{1/2}$=211,000 years). So the risk of decay and damage to the body from Tc-99 is minimal.

When Tc-99m decays, it emits a 140.5 keV gamma ray. The wavelength of this gamma ray is ideal for medical imaging. The single gamma ray without the presence of beta emission is advantageous for enhanced medical imaging.

Tc-99m is produced solely from the gamma decay of Molybdenum-99 (Mo-99). Due to Mo-99 having a relatively short half-life, it cannot be stored for an extended period of time. It must be continuously made, particularly because it is in such high demand.

Currently there are a limited number of (fission reactor) facilities producing Mo-99; any disruption of these facilities' operations can have severe effects on the supply chain and ultimately patient care. Additionally, producing the material via the fission process generates radioactive waste which is expensive to manage and dispose of.

SUMMARY OF THE INVENTION

An apparatus for producing high energy gamma rays using a neutron emitter is disclosed. The apparatus includes a neutron emitter mount configured to hold and position the neutron emitter. The neutron emitter is configured to emit neutrons with an average energy in the range of about 6 MeV to about 14.1 Mev producing a neutron output. The apparatus also includes a neutron moderator configured to reduce the average energy of the neutron output to about 6 MeV to about 14 MeV producing a moderated neutron output. The apparatus also includes a metal target configured to emit gamma rays of greater than about 8 MeV when exposed to the moderated neutron output. The apparatus may also include a neutron emitter configured to emit neutrons with an average energy in the range of about 6 MeV to about 14.1 Mev. The apparatus may also include a Molybdenum target. The Molybdenum target may include Mo-100, wherein some Mo-99 is formed by transformation of Mo-100 when the Molybdenum target is exposed to the gamma rays emitted by the metal target.

The neutron emitter may be a deuterium-tritium (D-T) Neutron generator. The metal target may comprise copper. The moderator may include at least one of water or polyethylene. The neutron emitter may be configured co-linearly with the neutron moderator and the neutron target to permit the moderator to reduce neutron energy to a desired average range before the neutrons collide with the metal target. The molybdenum target may comprise a coupon. The molybdenum target may comprise molybdenum disposed in a fluid. The apparatus may also include a tube configured to contain the molybdenum disposed in the fluid. The tube may comprise metal and may be configured as the metal target.

A method of producing gamma rays is also disclosed. The method includes providing a neutron output with an average energy of between about 6 MeV and about 14.1 MeV. The method also includes moderating the neutron output to produce a moderated neutron output with an average energy range of between about 6 MeV and about 14 MeV. The method also includes exposing a metal target to the moderated neutron output to produce gamma rays of greater than 8 MeV. The method may also include exposing a Molybdenum target comprising Mo-100 to the gamma rays produced by the metal target causing transformation of a portion of the Mo-100 into Mo-99. The method may also include collecting the Mo99 produced and transferring the Mo99 to a Technetium-99m generator.

The neutrons may be produced from a deuterium-tritium (D-T) Neutron generator. The metal target may comprise copper. The moderator may comprise polyethylene. The molybdenum target may comprise a coupon. The molybdenum target may comprise powdered molybdenum disposed in a fluid.

An apparatus for producing Mo-99 is also disclosed. The apparatus includes a neutron emitter configured to emit neutrons with an average energy in the range of about 6 MeV to about 14.1 Mev producing a neutron output. The apparatus also includes a neutron moderator configured to reduce the average energy of the neutron output to about 6 MeV to about 14 MeV producing a moderated neutron output. The apparatus also includes metal target configured to emit gamma rays of greater than about 8 MeV when exposed to the moderated neutron output. The apparatus also includes a Molybdenum target. The Molybdenum target may comprise Mo-100, wherein some Mo-99 is formed by transformation of Mo-100 when the Molybdenum target is exposed to the gamma rays emitted by the metal target.

DETAILED DESCRIPTION OF THE INVENTION

Figure 1:
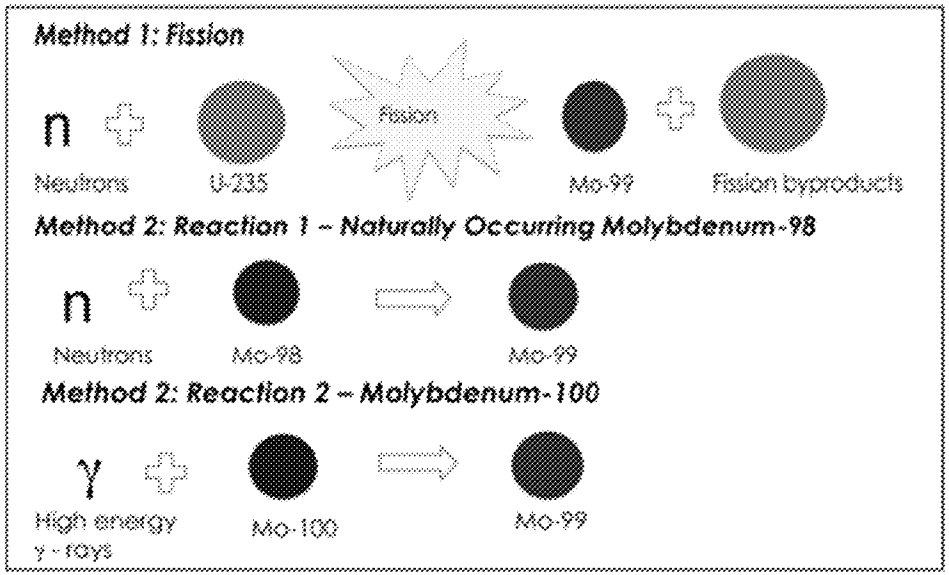
Figure 1 (Prior Art)
FIG. 1 is a diagram of the reactions that produce Mo99 from natural and man-made sources.

The present disclosure presents an alternative, non-fission technique for producing Mo-99 using neutrons and gamma rays from a variety of sources. The disclosed method and apparatus produces Mo-99 in useable quantities in a distributed fashion using naturally occurring Molybdenum-98 (Mo-98) and/or Molybdenum-100 (Mo-100), per the following reactions as shown in FIG. 1:

Mo-98+*n*=Mo-99→Tc-99m

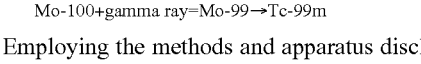

Mo-100+gamma ray=Mo-99→Tc-99m

Employing the methods and apparatus disclosed herein a user can produce Mo-99, on demand at their own facility, in ample quantities to support daily needs. The disclosed approach uses non-fission techniques for producing Mo-99, which decays to Tc-99m. There are no fission by-products produced and a local user is not affected by conditions inherent in supply chain disruptions (either at the source or due to transport).

Definitions

As used herein, the initials "eV" refer to the unit of energy electron volt. Similarly, as used herein, the initials "keV" refer to the unit of energy kilo-electron volt, 1 Kev equals 1000 eV; and the initials "MeV" refer to the unit of energy Mega-electron volt, 1 MeV equals $1\times10^6$ eV. As used herein eV, keV, MeV generally refers to the energy and/or the momentum of a subatomic particle.

As used herein, the initials "Mo" refer to the element molybdenum. Similarly, as used herein, the initials "Mo-98" refers molybdenum 98 a naturally occurring isotope of molybdenum; the initials "Mo-99" refers molybdenum 99 an unstable isotope of molybdenum; and the initials "Mo-100" refers molybdenum 100 a naturally occurring isotope of molybdenum.

As used herein, the initials "Tc" refer the element technetium. Similarly, as used herein, the initials the initials "Tc-99m" refers technetium 99 (metastable) an unstable isotope of technetium (its half-life is about 6 hours); and the initials "Tc-99" refers technetium 99 a relatively stable isotope of technetium (half-life is about 221,000 years).

As used herein, the letter "U" refer the element uranium. Similarly, as used herein, the initials the letter "U-235" refers Uranium 235, which is at levels above 20% is considered to be highly enriched uranium (HEU).

As used herein, the term "D-T neutron generator" refers to a deuterium-tritium neutron generator.

As used herein, the terms "target" and "coupon" may be used interchangeably to refer to an object designed to be impacted with subatomic particles.

As used herein, the terms "neutron generator" and "neutron emitter" are used interchangeably. Both terms mean any source of neutrons, including fusion generators and radio-material which emit neurons.

Current methods for producing Mo-99 for use in the production of Tc-99m require enriched uranium 235 (U-235). Production of Mo-99 from U235 requires substantial capital costs for the production of the seed U-235 material. Currently only five facilities in the world regularly and commercially produce Mo-99 from U-235. Additionally, using U-235 to produce Mo-99 produces a number of undesirable and hazardous radioactive by products. Finally, U-235 is a highly regulated and politically sensitive material making it further undesirable as a starting material for the production of Mo-99.

By contrast, producing Mo-99 directly from Mo-100 is clean in that no other material is produced beyond Mo-99. None of Mo-99, its decay product Tc-99m (and a beta particle), their decay products Tc-99 (and a gamma ray) or Mo-100 are regulated or politically sensitive. The radio-material and particles emitted are easily handled safely.

Mo-99 can be produced from Mo-100 through the bombardment of Mo-100 with a gamma ray of sufficient energy. However, until now the only facilities producing Mo-99, which decays to Tc-99m have been fission facilities using U targets. However, with an apparatus and method of producing high energy gamma rays from neutron bombardment of a metal target it is shown that Mo99—and, therefore, Tc99m—can be produced outside of a major nuclear facility.

Figure 2:
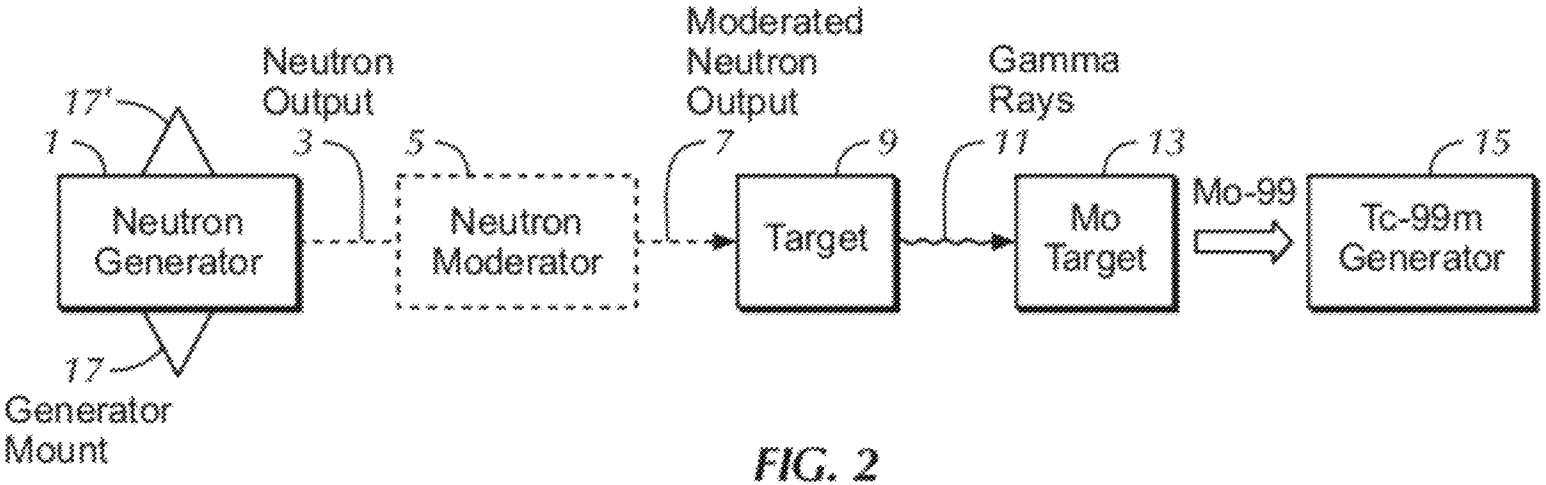
FIG. 2 is a schematic diagram of an apparatus configured to produce Mo99 from Mo100 by bombardment with gamma rays.

FIG. 2 is a block diagram of an apparatus configured to produce Mo-99 from naturally occurring molybdenum. A neutron generator (1) configured to emit high energy neutrons, is induced to emit neutrons (3) so that they pass through a neutron moderator (5) of sufficient moderation to reduce the energy of the neutrons (3) to moderated neutrons (7) which possess an energy with an ideal average range for the configuration of that system. The moderator (5) may be a liquid such as water and/or solid, such as polyethylene. The moderated neutrons (7) then collide with the target (9). As a result of exposure to the moderated neurons (7) to the metal target (9) a high energy gamma ray (11) is emitted from the target (9). The high energy gamma ray (11) is allowed to collide with a Mo100 molybdenum target (13) (molybdenum target). The high energy gamma ray collision causes some atoms of the Mo-100 molybdenum target (13) to transform into Mo-99. Mo-99 can be separated, collected and used in a technetium-99m generator (not shown). In order to fix, secure and position the neutron generator (1) it is mounted on a mount (17) or plurality of mounts (17, 17').

Figure 3:
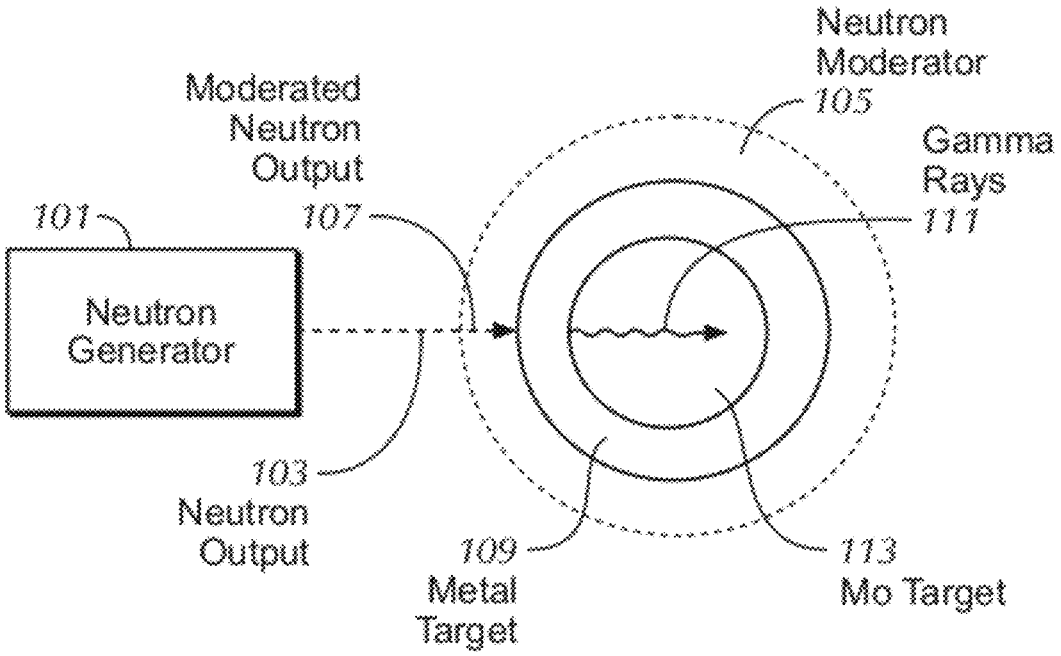
FIG. 3 is a schematic diagram of another embodiment of an apparatus configured to produce Mo99 from Mo100 by bombardment with gamma rays.

FIG. 3 shows another embodiment configured to produce Mo-99 from naturally occurring molybdenum. A neutron generator (101) configured to emit high energy neutrons, is induced to emit neutrons (103) so that they pass through a neutron moderator (105) of sufficient moderation to reduce the energy of the neutrons (103) to moderated neutrons (107) which possess in energy within an ideal average range for the configuration of that system. In this embodiment the moderator is in the form of hollow cylinder surrounding the target (109). The metal target (109) is also in the shape of a hollow cylinder surrounding the Mo-100 molybdenum target (113). The moderated neutrons (107) then collide with the metal target (109). As a result of exposure to the moderated neurons to the metal target (109) a high energy gamma ray (111) is emitted from the metal target (109). The high energy gamma ray is allowed to collide with the Mo100 molybdenum target (113). The high energy gamma ray collision causes some atoms of the Mo-100 molybdenum target (113) to transmute into Mo-99. The moderator (105) may be a liquid such as water and/or solid, such as polyethylene. The metal target (109) is metal pipe configured to contain the Mo-100 molybdenum target (113). The Mo-100 molybdenum target may be in the form of crystals suspended in a liquid. This embodiment allows the molybdenum target and the transmuted product to be pumped through a metal tube. The suspended Mo-100 molybdenum target is pumped into the presence of the gamma rays, causing a portion to transform into Mo-99. The resulting solution containing Mo-100 and Mo-99 may be processed using conventional techniques. Mo-99 may be collected and used in a technetium-99m generator (not shown). The Mo-100 portion may be pumped back into the apparatus for further transmutation. This embodiment allows for continuous transmutation and collection. In some forms of this embodiment the metal tube and its moderating insulation may be coiled around the neutron source.

While still referring to FIG. 3, a slightly different embodiment can be explained. In this embodiment the metal target (109) is again a tube. Likewise, source of Mo-100 (113) is a suspended crystal flowing through the metal target (109). However, the moderator (105) may also be a tube made of a moderating material, for instance polyethylene. The moderating tube contains a moderating liquid, e.g., water or heavy water. The metal target (109) is configured to be contained within the moderating tube (105) composed of moderating material containing moderating liquid. This embodiment features Mo-98 crystals suspended in the moderating material. Mo-98 in the presence of energetic neutrons is transmuted into Mo-99. The moderating liquid containing Mo-98 and Mo-99 may be pumped to a column for separation by chromatography as discussed above. After separation the Mo-99 may be collected put into a Tc-99m generator. Meanwhile, the untransmuted Mo-98 may be pumped backing into the system for further transmutation. In another embodiment the parallel tubes may be coiled around the neutron generator. This provides an improved configuration using the neutron source to produce gamma rays for the production of Mo-99 and also producing Mo-99 directly from neutron emission without involving a gamma ray intermediary. In another embodiment, the moderator may surround the neuron generator, and the metal tube may be coiled around the moderator.

Figure 4:
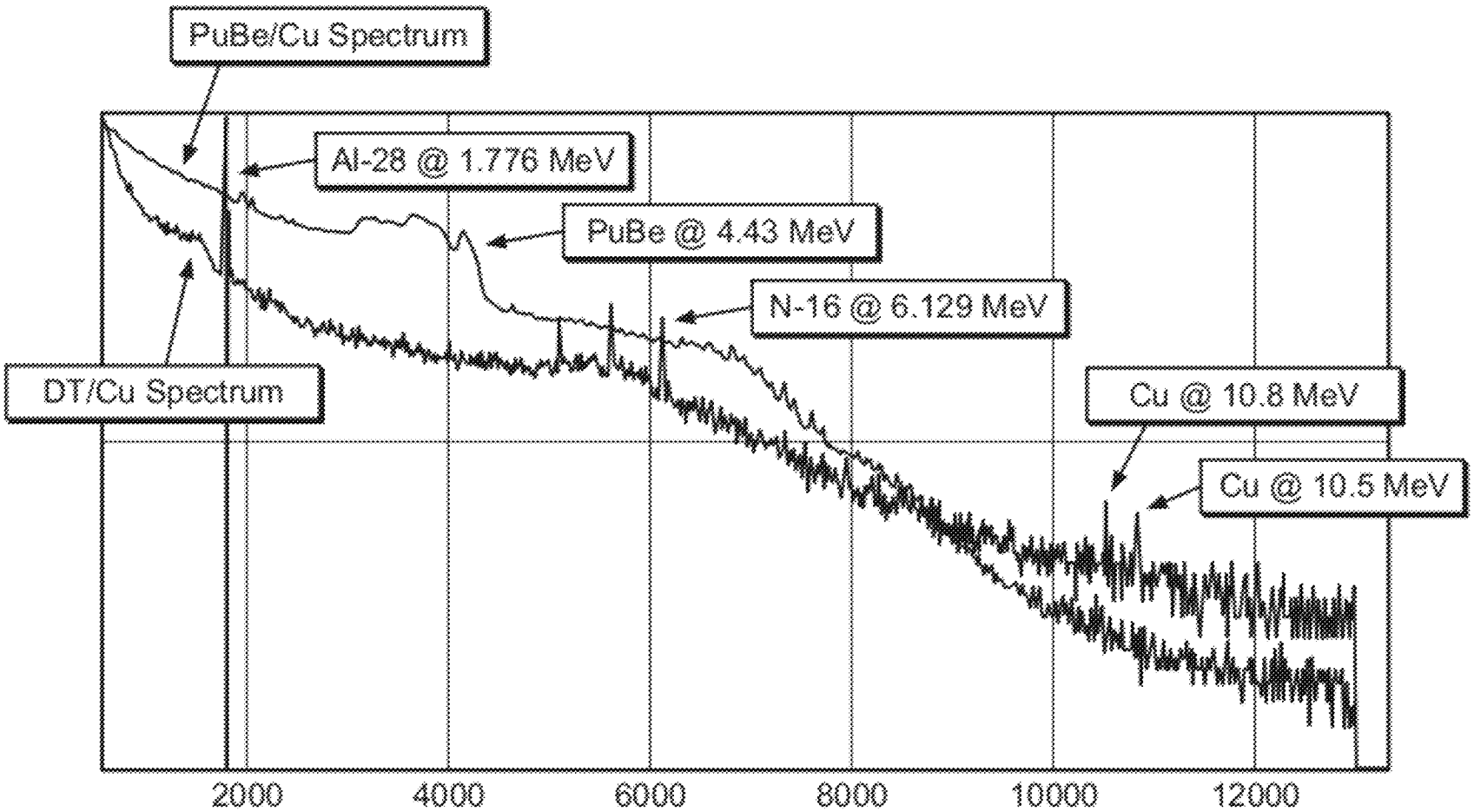
FIG. 4 is a graph of test results using copper as a metal target.

FIG. 4 is a graph showing test results according to a Bicron 2×2 NaI detector from a test run using the apparatus of FIG. 2. In this case the metal target is copper. Following the graph of the data from the DT/Cu spectrum peaks can be seen of excitation of N-16, and Cu. These peaks indicate this configuration of the apparatus produced gamma rays with energies of at least 6.129 MeV, 10.5 MeV and 10.8 MeV. These observed peaks indicate the presence of gamma rays with energies of at least 10.8

Figure 5:
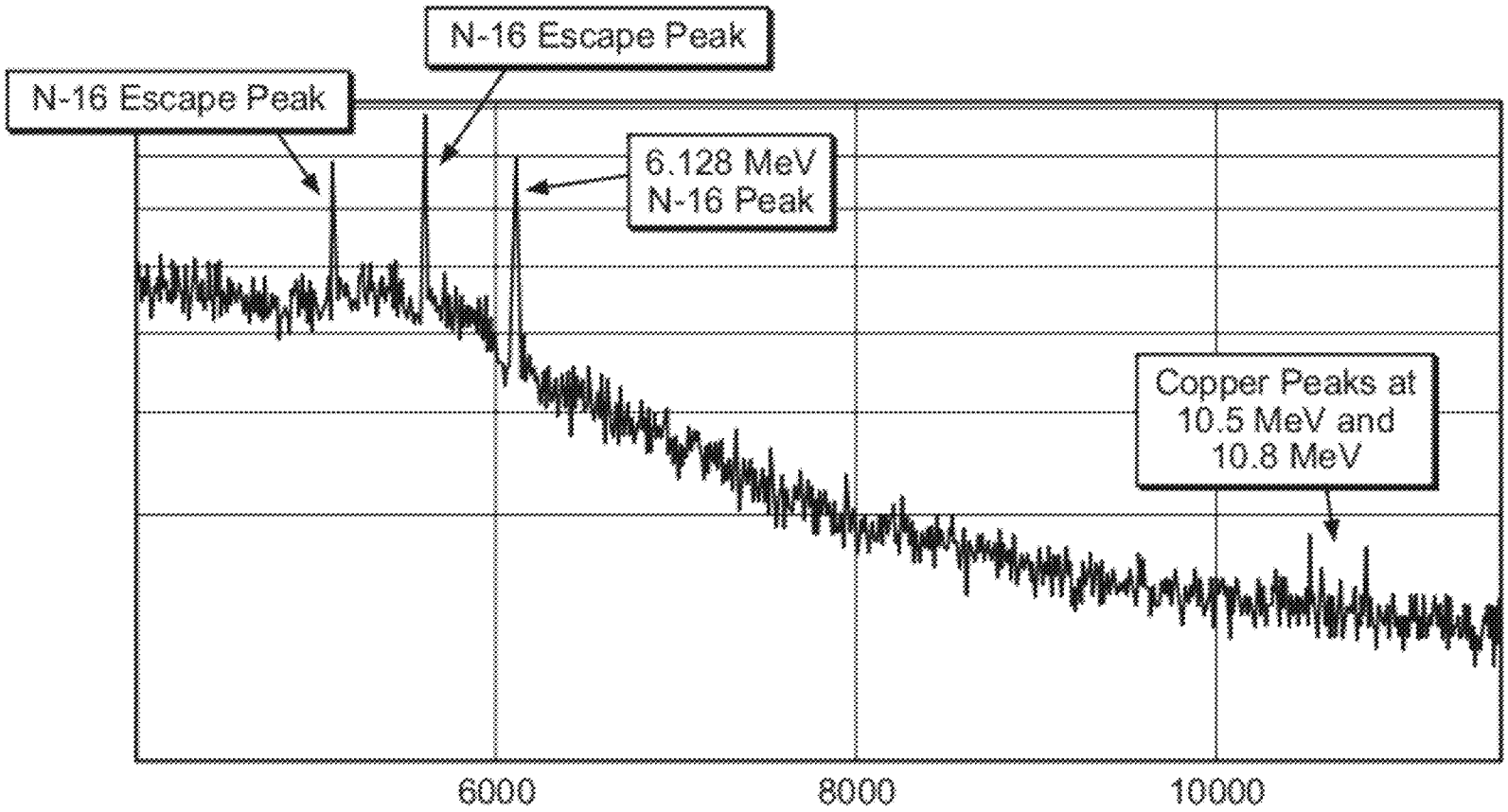
FIG. 5 is a graph of additional test results also using copper as a metal target.

FIG. 5 is a graph showing results according to a Bicron 2×2 NaI detector of another test run using apparatus of FIG. 2. Again a copper target is used. Following the graph of the data the spectrum peaks can be seen of excitation of N-16 at 6.129 MeV. This indicates this configuration of the apparatus produced gamma rays of at least 6.129 MeV. Peaks can also be observed of Cu at 10.5 MeV and 10.8 MeV. These observed peaks indicate the presence of gamma rays with energies of at least 10.8 MeV.

Gamma Ray Sources

Mo99 can be produced from Mo-98 and Mo100 according to the following reactions as shown in FIG. 1:

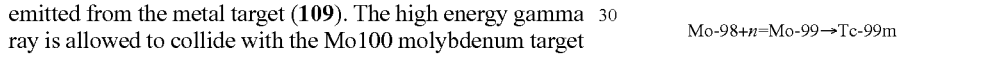

$$\text{Mo-98}+n=\text{Mo-99}\rightarrow\text{Tc-99m}$$

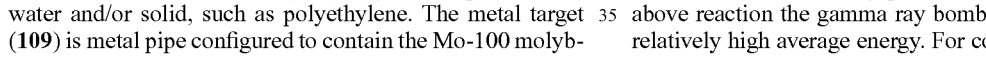

$$\text{Mo-100}+\text{gamma ray}=\text{Mo-99}\rightarrow\text{Tc-99m}$$

However, to efficiently produce Mo-99 according to the above reaction the gamma ray bombardment should have a relatively high average energy. For commercial and medical production of Mo99 to be used in a Technetium-99m generator average energies of about 8 MeV or higher are generally required. No known semi-stable radioactive material produces gamma rays of that high of an average energy. To date, only particle accelerators have been capable of producing high energy gamma ray of 8 MeV or higher. Particle accelerators capable of producing these high energy gamma rays are large facilities with high capital costs, and require dozens or more of technicians to operate. As a result there are only a few such facilities that are capable of producing such high energy gamma rays. Only five facilities produce Mo-99 for commercial and medical purposes, although it should be noted that U-235 fission is the method most of these reactors use for the production of Mo-99.

It has now been demonstrated that a particle accelerator is not required to produce high energy gamma rays. Using neutron bombardment of a metal target, high energy gamma rays may be reliably produced. It has also been demonstrated that these gamma rays may be employed to produce Mo-99 from naturally occurring Mo-100 for use in the production of Tc-99m for medical imaging.

A high energy neutron source with an average energy of at least about 6 MeV must be used in the bombardment. The neutrons must be directed to pass through a moderator of some variety to reduce the energy of the neutron to a desired energy for the construction of the system. The ideal energy range varies with the specifics of a given system. Many factors have to be considered in the choice of the amount of moderation. These factors include, but are not limited to, the type of metal target used, thickness and density, the distance from the neutron source to the metal target, the geometry and pattern of the neutron emission and the position of the metal target in relation to the neutron emitter. From the below described examples and other observations, the determined range of the average neutron energy at the moment of collision with the target is between about 6 MeV and about 14 MeV.

It has been demonstrated that a metal target in the presence of neutrons moderated to be within a particular range of average neutron energy will produce gamma rays of greater than 8 MeV. Gamma rays of this intensity are suitable for the production of Mo-99 from Mo-100 for commercial and medical purposes. It is also demonstrated and understood that average neutron energies moderated to be below the determined range (i.e. those below 6 MeV) are mostly unsuitable for producing high energy gamma rays. Conversely, it is also demonstrated that average neutron energies above the determined range also fail to produce optimal output of high energy gamma rays. Therefore, the emitted neutrons must be moderated to an average energy within the determined range (i.e. between about 6 MeV and about 14 MeV) for optimal efficiency in the production of Mo-99 and from Mo-100. However, for each configuration of the described system the optimal range of average neutron energies to produce the most high energy gamma rays will vary according to the parameters of that particular system. However, an optimal range of average neutron energies at collision with the target can be determined.

The Monte Carlo approach of using a probabilistic analog to solve a deterministic problem is ideally suited to solving neutron path problems. The Monte Carlo method was invented for this purpose and can be applied in this situation to deducing a suitable configuration for producing high energy gamma rays. Monte Carlo N-Particle Transport Code (MCNP) is used in this study to simulate neutron transport from the D-T generator to the target for the production of high energy gamma rays.

The input consists of a cell card, surface card, and data card. The cell card describes the problem space within respective boundaries. The surface card describes the problem geometry using Cartesian coordinates. The data card defines problem specifications, including information about the neutron source and energy distribution, as well as tally counts. Tallies are a crucial element of MCNP, for it provides the user with information about current across a certain point, fluxes, etc. The MCNP code that was used for these purposes focuses on the neutron tally over each surface, the average neutron flux over each surface, the average neutron flux within the target itself, and the energy deposition in the target. The energy distribution of the neutron source is normal Gaussian. Parameters in the code can easily be changed to provide updated information about the experiment.

Neutron Generator

The neutron generator produces free neutrons which is referred to as the neutron output. Any source of neutron emissions that is capable of producing neutrons of the energy and quantity to produce a gamma ray when exposed to a target may be used with the apparatus and method described herein, including deuterium-tritium (D-T) neutron generators.

Deuterium-tritium (D-T) Neutron Generators.

D-T neutron generators are the neutron emitters used in the examples presented herein. D-T neutron generators produce neutrons by creating ions of deuterium, tritium, or deuterium and tritium and accelerating these into a hydride target loaded with deuterium, tritium, or deuterium and tritium. The DT reaction is used more than the DD reaction because the yield of the DT reaction is 50-100 times higher than that of the DD reaction.

$$D+T \rightarrow n+4He \quad En=14.1 \text{ MeV}$$

$$D+D \rightarrow n+3He \quad En=2.5 \text{ MeV}$$

Neutrons produced from the DT reaction are emitted isotropically (uniformly in all directions) from the emitter while neutrons from the DD reaction are slightly peaked in the forward (along the axis of the ion beam) direction. In both cases, the associated He nuclei (alpha particles) are emitted in the opposite direction of the neutron.

The gas pressure in the ion source region of the neutron tubes generally ranges between 0.1-0.01 mm Hg. The mean free path of electrons must be shorter than the discharge space to achieve ionization (lower limit for pressure) while the pressure must be kept low enough to avoid formation of discharges at the high extraction voltages applied between the electrodes. The pressure in the accelerating region has however to be much lower, as the mean free path of electrons must be longer to prevent formation of a discharge between the high voltage electrodes.

The basic design of a modern compact accelerator neutron does not vary much from those of other particle accelerators. It consists of a source to generate positively charged ions; one or more structures to accelerate the ions (usually up to ~110 kV); a metal hydride target loaded with either deuterium, tritium, or a mixture of the two; and a gas-control reservoir, also made of a metal hydride material. The most common ion source used in neutron generators is a cold-cathode, or Penning ion source, which is a derivative of the Penning trap used in Penning ion gauges. This simple ion source consists of a hollow cylindrical anode (usually biased 1-2 kV) with cathode plates at each end of the anode (usually at ground potential). An external magnet is arranged to generate a coaxial field of several hundred gauss within the ion source.

When deuterium and/or tritium gas is introduced into the anode at a pressure of a few millitorr, the electric field between the anode and cathodes ionizes the gas. Electron confinement is established in this plasma because of the orientation of the electric and magnetic fields, which forces the electrons to oscillate back and forth between the cathode plates in helical trajectories. Although some low-energy electrons are lost and strike the anode, which creates more secondary electrons, most remain trapped and ionize more gas molecules to sustain the plasma. The ions are not similarly trapped, and when they strike the cathodes, they also release secondary electrons, which enter the plasma and help sustain it. Ions, however, can escape the chamber into the acceleration section of the tube through a hole at the center of one of the cathodes.

The ion accelerator usually consists of several electrodes with cylindrical symmetry, acting as electric lenses. The ion beam can be focused to a small spot of the target that way. The accelerators usually have several stages, with voltage between the stages not exceeding 200 kV to prevent field emission.

In comparison with radionuclide neutron sources, neutron tubes can produce much higher neutron fluxes and monochromatic neutron energy spectrums can be obtained. The neutron production rate can also be controlled.

The central part of a neutron generator is the particle accelerator itself, also referred to as the neutron tube. Neutron tubes have several components including an ion source, ion optic elements, and a beam target; all of these are enclosed within a vacuum tight enclosure. High voltage insulation between the ion optical elements of the tube is provided by glass and/or ceramic insulators. The neutron tube is, in turn, enclosed in a metal housing, the accelerator head, which is filled with a dielectric media to insulate the high voltage elements of the tube from the operating area. The accelerator and ion source high voltages are provided by external power supplies.

In comparison with their predecessors, sealed neutron tubes do not require vacuum pumps and gas sources for operation. They are therefore more mobile and compact. Another advantage of the D-T generator is the ability to turn off the neutron generation by disconnecting the power source.

An ion source provides an ion beam without consuming much of the gas. For hydrogen isotopes, production of atomic ions is favored over molecular ions, as atomic ions have higher neutron yield on collision. The ions generated in the ion source are then extracted by an electric field into the accelerator region, and accelerated towards the target. The gas consumption is chiefly caused by the pressure difference between the ion generating and ion accelerating spaces that has to be maintained. Ion currents of 10 mA at gas consumptions of 40 $cm^3$/hour are achievable.

For a sealed neutron tube, the ideal ion source should use low gas pressure, give high ion current with large proportion of atomic ions, have low gas clean-up, use low power, have high reliability and high lifetime, its construction has to be simple and robust and its maintenance requirements have to be low.

Gas can be efficiently stored in a replenisher, an electrically heated coil of zirconium wire. Its temperature determines the rate of absorption/desorption of hydrogen by the metal, which regulates the pressure in the enclosure.

The basic design of a modern compact accelerator neutron does not vary much from those of other particle accelerators. It consists of a source to generate positively charged ions; one or more structures to accelerate the ions (usually up to ~110 kV); a metal hydride target loaded with either deuterium, tritium, or a mixture of the two; and a gas-control reservoir, also made of a metal hydride material. The most common ion source used in neutron generators is a cold-cathode, or Penning ion source, which is a derivative of the Penning trap used in Penning ion gauges. This simple ion source consists of a hollow cylindrical anode (usually biased 1-2 kV) with cathode plates at each end of the anode (usually at ground potential). An external magnet is arranged to generate a coaxial field of several hundred gauss within the ion source.

When deuterium and/or tritium gas is introduced into the anode at a pressure of a few millitorr, the electric field between the anode and cathodes ionizes the gas. Electron confinement is established in this plasma because of the orientation of the electric and magnetic fields, which forces the electrons to oscillate back and forth between the cathode plates in helical trajectories. Although some low-energy electrons are lost and strike the anode, which creates more secondary electrons, most remain trapped and ionize more gas molecules to sustain the plasma. The ions are not similarly trapped, and when they strike the cathodes, they also release secondary electrons, which enter the plasma and help sustain it. Ions, however, can escape the chamber into the acceleration section of the tube through a hole at the center of one of the cathodes.

Linear Accelerators.

Linear accelerators are capable of emitting neutrons of average energies between 6 MeV and 14 MeV. In fact linear accelerators can emit neutrons in much higher energies, 20 MeV is common and 40 MeV is achievable. Linear accelerators are a suitable source of neutrons to be used with the described apparatus and method.

Fusion Reactors.

It is typical of fusion reactors to fuse deuterium and tritium to produce He and energy. As discussed above the fusion of deuterium and tritium emits neutrons at an average energy of 14.1 MeV. As discussed about 14.1 MeV is a suitable input energy of neutrons for use with the described method. Fusion reactors are a suitable source of neutrons to be used with the described apparatus and method.

Radioactive Material.

Most radioactive material is emits neutrons with insufficient energies to be suitable for use with these methods and these apparatuses. At this time is not known if any semi stable radioactive material that during their decay produce average neutron energies of much more than the minimum average of neutron energies of the determined range. However, it is possible to configure a system using radioactive material as a source of neutrons, by carefully controlling and selecting other factors in the design of the system. Certain radioactive materials are a suitable source of neutrons to be used with the certain configurations of described apparatus and method.

Neutron Moderators

The neutron moderator serves to slow the neutron output to produce a moderated neutron output. It is necessary to moderate the neutron output to achieve greater efficiency in the production of gamma rays when the neutron output is exposed to the target material. Any material that can reduce the energy of free neutrons can be used as a moderator in this method or apparatus.

Water is highly suitable as a neutron moderator. Any form of water may be used with the described apparatus and methods. Light water is readily available, inexpensive and suitable as a neutron moderator. Although, comparatively expensive and less available, heavy water is more effective as neutron moderator.

Polyethylene is also an effective neutron moderator. Polyethylene is more efficient in neutron moderation than light water, so less material is required to achieve the same amount of moderator.

Methane is also an effective neutron moderator. If a cold or liquid system is desired, methane is particularly useful in the form of liquid methane. Liquid methane is both an effective moderator and an effective coolant to keep the system at a desired temperature. Similarly, liquid hydrogen can be used to achieve similar results.

Carbon is also an effective moderator and can be used in the described apparatus and methods to moderate the neutron output and produce a moderated neutron output. Any form of carbon can be used. Graphite is common used as a moderator in nuclear reactor and it suitable to be used as a moderator in the described apparatus and methods. In embodiments such as depicted in FIG. 3, where the moderator flows, carbon dioxide gas is suitable as a moderator and can be used to moderate the neutron output. If there is desire for the moderator to be conductive, pyrolytic carbon suitable as a moderator and an excellent conductor. In combination with hydrogen paraffin is an effective moderator of neutron and be employed to moderate the neutron output.

If the system is designed for a gas moderator, such embodiments can be configures as shown in FIG. 3, helium is an effective neutron moderator. Additional if the system is desired to be cooled, liquid helium can serve a dual propose as a neutron moderator and a coolant.

Metal Targets

Almost any metal may be used with the described apparatus and methods as a target that produces gamma rays when exposure to a moderated neutron output. Pure metals may be used with the described apparatus and methods, as well as alloys. Layers of different metals or layers the same metal in different configurations can also be used with described apparatus and methods. Copper, tungsten, titanium, aluminum are all suitable as metal targets of the described apparatus and methods. Alloys such as stainless steel and nickel-chromium are also suitable for use with the described apparatus and methods.

The thickness of the metal target ought to be considered with designing a particular system. Consideration should be given to provide enough metal so that gamma rays are produced when the metal target is exposed to the moderated neutron output. However the thickness of the metal target should not be so great as to substantially interfere with the emission of the gamma rays produced. For instances, it is anticipated that effective systems can be configured using copper in thicknesses from about 2.5 μm to about 100 mm. The cross section of the metal nuclei and the density of the nuclei along a linear path from the target through the moderator to the neutron generator should be considered.

Molybdenum

In order to produce Mo-99, a molybdenum target comprising Mo-100 is introduce to the gamma rays produced by the metal target. For efficient transformation of Mo-99 from Mo-100 the gamma rays should have an average energy of about 8 MeV.

Almost any source of Mo-100 can be used in the molybdenum target. Naturally occurring sources of molybdenum contain sufficient portions of molybdenum for use with the described apparatus and methods. Purified Mo-100 can also be used to produce Mo-99 with the described apparatus and methods. Mo-100 enriched sources of molybdenum can also be used to produce Mo-99 with the described apparatus and methods. Alloys of molybdenum or containing molybdenum could be used to produce Mo-99 with the described apparatus and methods provided those alloy comprised in part Mo-100. Certain by-products, slags and wastes of other industries (for non-limiting examples nuclear reactors, particle accelerators, mining, metallurgy and refining industries) which contain Mo-100 can be used with the described apparatus and methods to produce Mo-99.

The molybdenum target can be in almost any state of matter during the use of described apparatus or use of the described methods. It is conceived that the molybdenum target might be configured in forms such as a solid coupon, a salt dissolved in a fluid, a powder, a colloidal suspension in fluid, a powder dispersed in a fluid (especially a gas), or the molybdenum itself could be heated into a melted liquid state.

The yield of described method can be augmented if the apparatus conducting the described method situated some molybdenum comprising Mo-98 in the presence of the neutron source in a configuration that does not significantly interfere with production of Mo-99 from Mo-100. As shown in FIG. 1, it is possible to transform Mo-98 into Mo-99 in the presence of free neutrons. Therefore, by introducing a source of Mo-98 to the neutrons emitted by the neuron generator in a configuration benign to the production of Mo-99 from Mo-100 additional Mo-99 can be produced.

EXAMPLES

Example 1

Configuration 1, Run 1.

Figure 6:
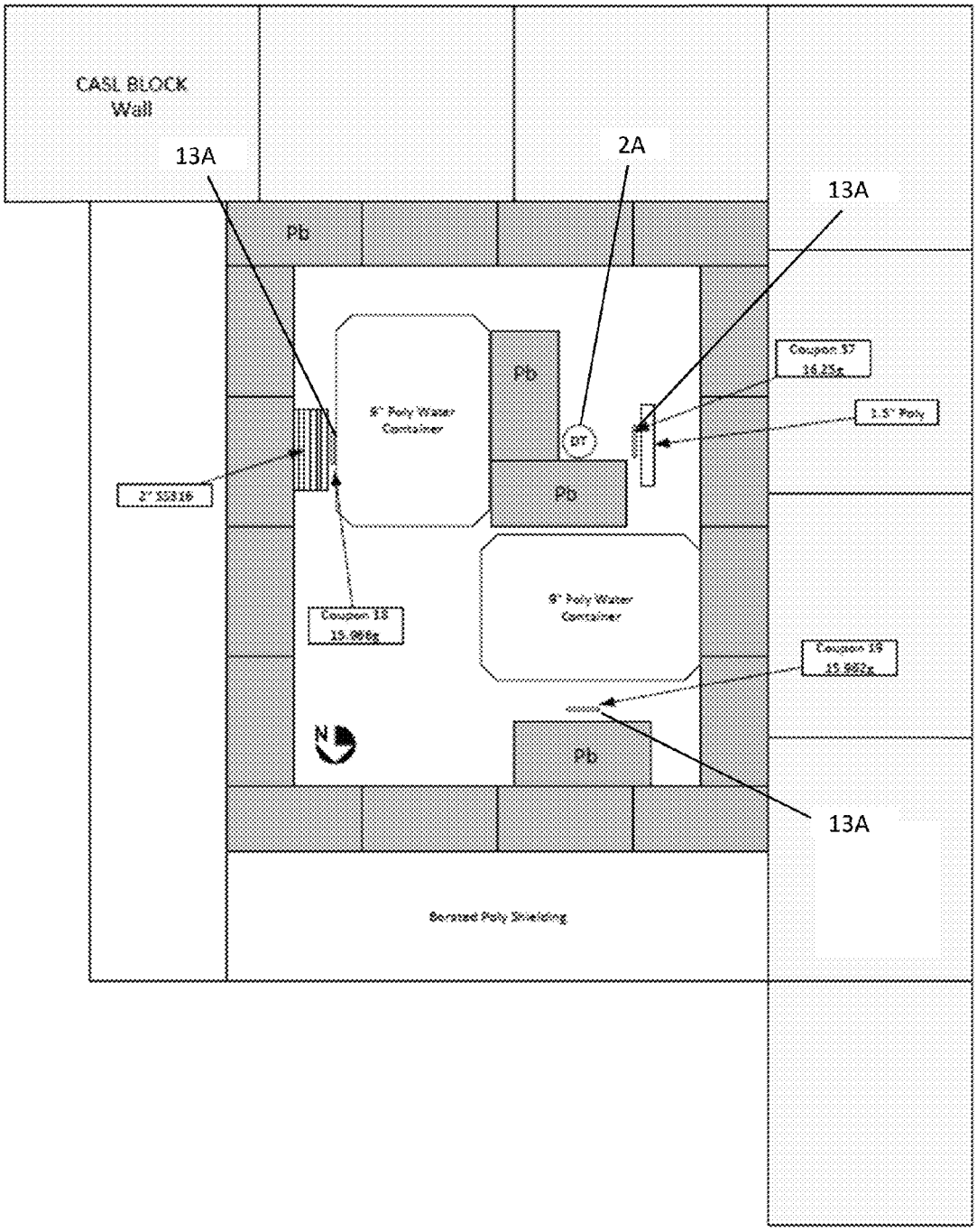
FIG. 6 is a diagram of the laboratory room during the conduction of the test described in Example 1.

The laboratory was configured as depicted in FIG. 6 using shielding of the type, thickness and orientation as indicated in the figure. The targets of the test were 3 molybdenum coupons 13A (Coupon Nos. 8, 9, and 10) each containing about 16 g of naturally occurring molybdenum. A D-T neutron generator 2A was activated for 15.5 hours in the presence of the coupons. At the conclusion of the test the coupons were tested for radioactivity. The amount of radioactivity is indicative of the amount of molybdenum transformed into Tc-99m. The results are shown below in Table 1.

TABLE 1

| Run Identification | Run Time (hrs) | Coupon No. | Weight | Activity MicroCuries/g | Activity MicroCuries |
|---|---|---|---|---|---|
| Config. 1 Run #1 | 15.5 | 8 | 16.034 | <MDA | <MDA |
| | | 9 | 16.133 | 1.6700E−05 | 2.6942E−04 |
| | | 10 | 16.053 | 2.4080E−03 | 3.8656E−02 |

Example 2

Configuration 1, Run 2.

Figure 7:
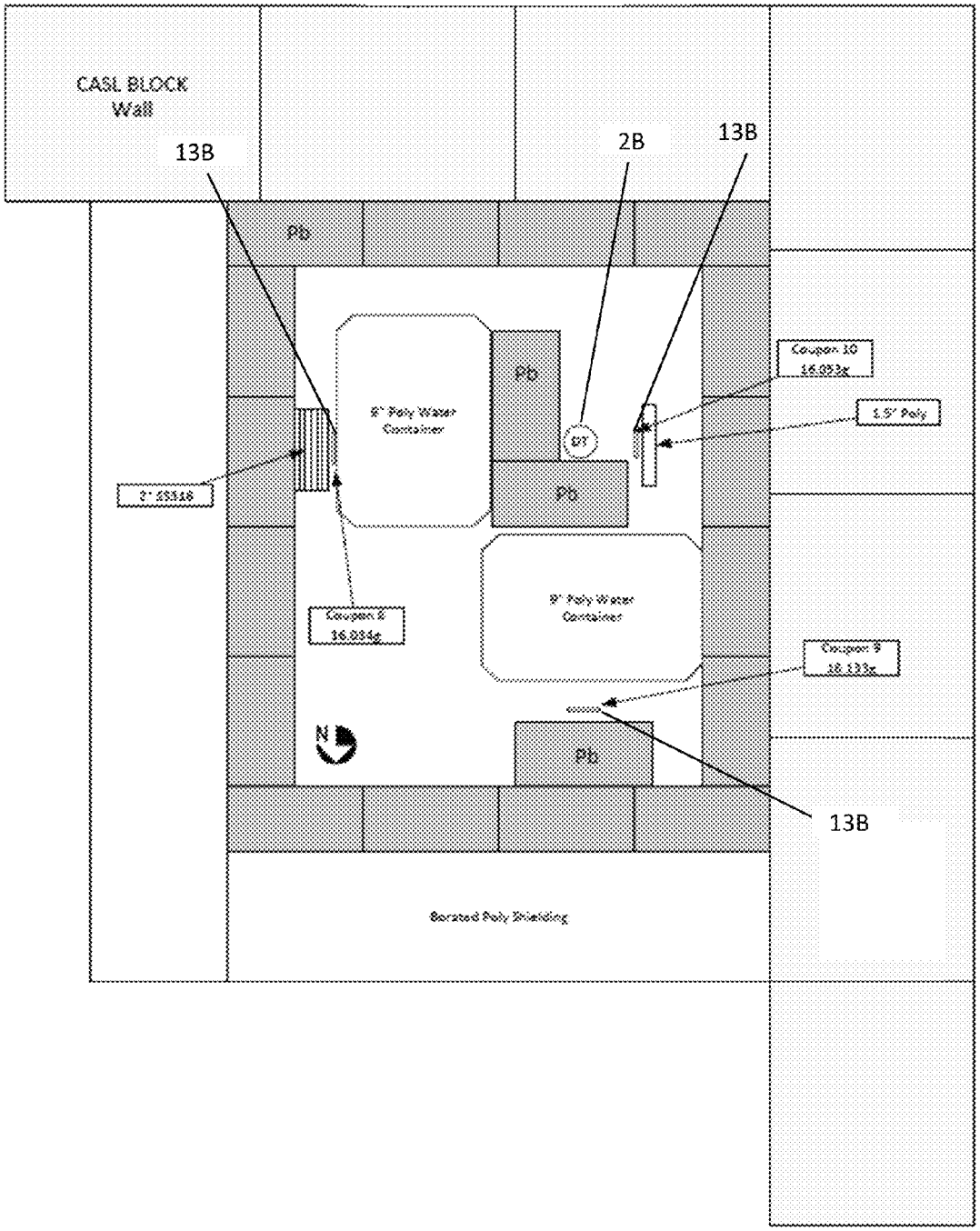
FIG. 7 is a diagram of the laboratory room during the conduction of the test described in Example 2.

The laboratory was configured as depicted in FIG. 7 using shielding of the type, thickness and orientation as indicated in the figure. The targets of the test were 3 molybdenum coupons 13B (Coupon Nos. 37, 18, and 19) each containing about 16 g of naturally occurring molybdenum. A D-T neutron generator 2B was activated for 16 hours in the presence of the coupons. At the conclusion of the test the coupons were tested for radioactivity. The amount of radioactivity is indicative of the amount of molybdenum transmutating into Tc-99m. The results are shown below in Table 2.

TABLE 2

| Run Identification | Run Time (hrs) | Coupon No. | Weight | Activity MicroCuries/g | Activity MicroCuries |
|---|---|---|---|---|---|
| Config. 1 Run #2 | 16 | 37 | 16.025 | 1.0990E−03 | 1.7611E−02 |
| | | 18 | 15.962 | 1.4410E−05 | 2.3001E−04 |
| | | 19 | 15.966 | 7.6860E−06 | 1.2271E−04 |

Example 3

Configuration 2.

Figure 8:
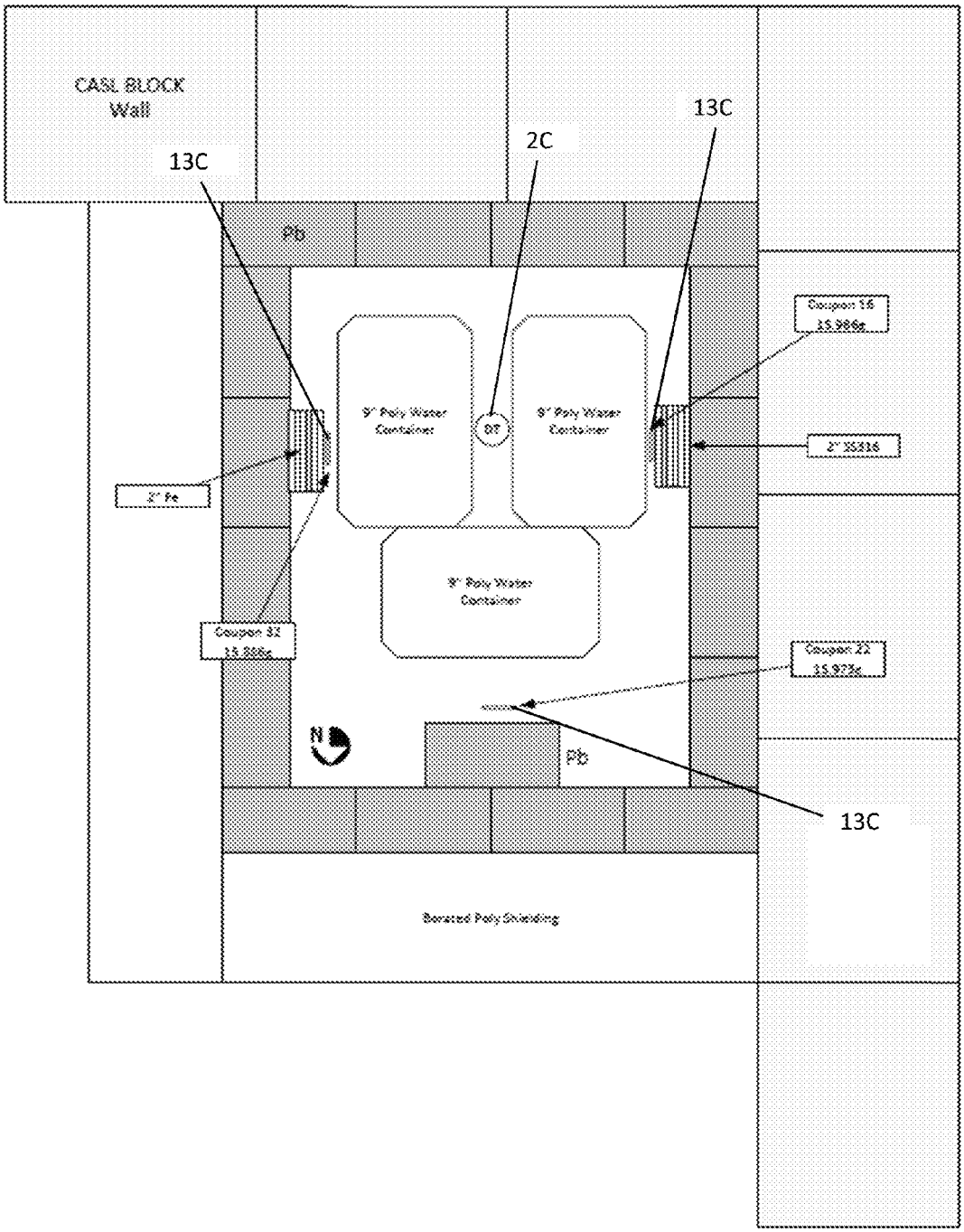
FIG. 8 is a diagram of the laboratory room during the conduction of the test described in Example 3.

The laboratory was configured as depicted in FIG. 8 using shielding of the type, thickness and orientation as indicated in the figure. The targets of the test were 3 molybdenum coupons 13C (Coupon Nos. 16, 22 and 32) each containing about 16 g of naturally occurring molybdenum. A D-T neutron generator 2C was activated for 16 hours in the presence of the coupons. At the conclusion of the test the coupons were tested for radioactivity. The amount of radioactivity is indicative of the amount of molybdenum transformed into Tc-99m. The results are shown below in Table 3.

TABLE 3

| Run Identification | Run Time (hrs) | Coupon No. | Weight | Activity MicroCuries/g | Activity MicroCuries |
|---|---|---|---|---|---|
| Configuration | 16 | 16 | 15.969 | 1.2840E−05 | 2.0504E−04 |
| | | 22 | 15.973 | <MDA | <MDA |
| | | 32 | 15.886 | <MDA | <MDA |

Example 4

Configuration 3.

Figure 9:
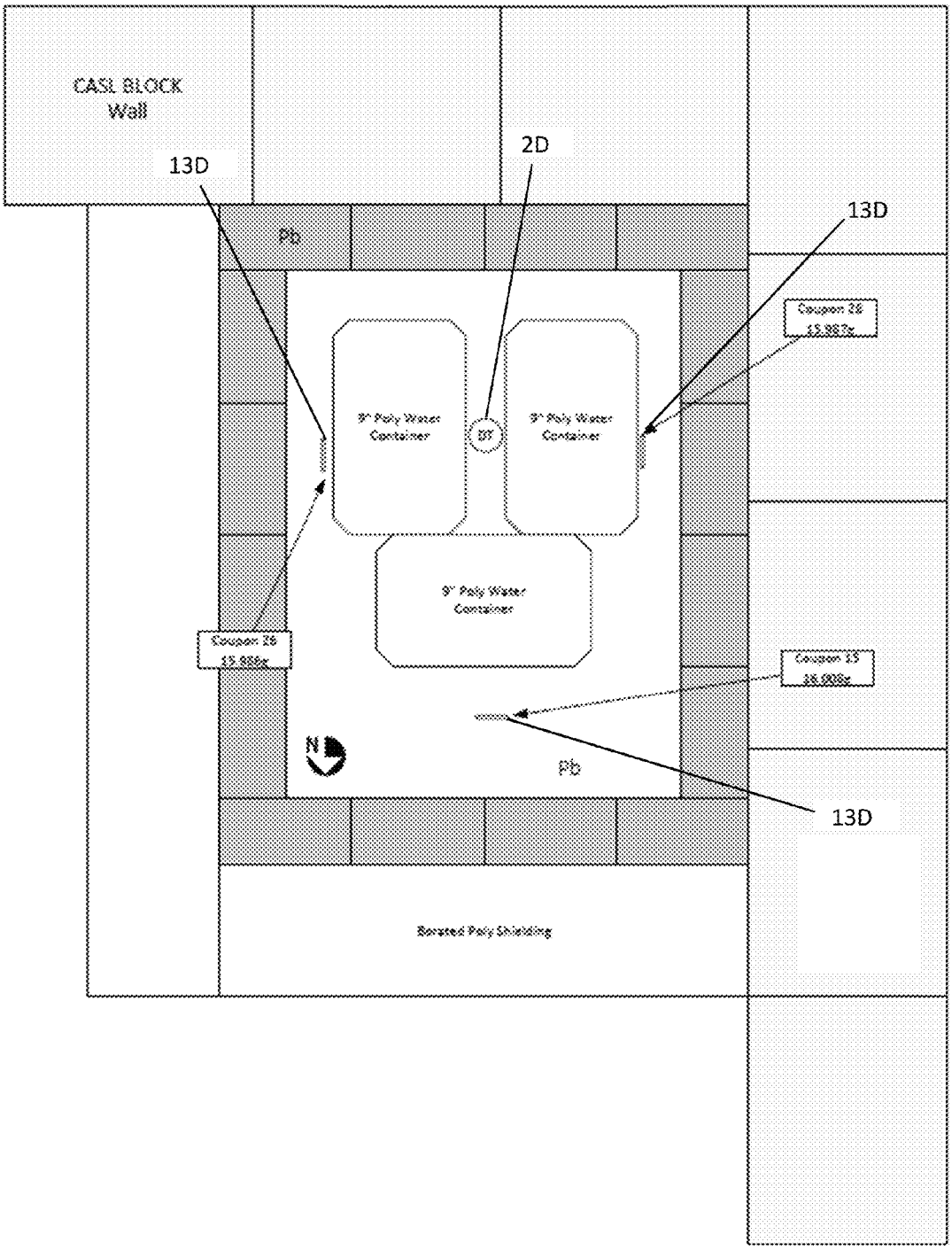
FIG. 9 is a diagram of the laboratory room during the conduction of the test described in Example 4.

The laboratory was configured as depicted in FIG. 9 using shielding of the type, thickness and orientation as indicated in the figure. The targets of the test were 3 molybdenum coupons 13D (Coupon Nos. 28, 15 and 26) each containing about 16 g of naturally occurring molybdenum. A D-T neutron generator 2D was activated for 16.5 hours in the presence of the coupons. At the conclusion of the test the coupons were tested for radioactivity. The amount of radioactivity is indicative of the amount of molybdenum transformed into Tc-99m. The results are shown below in Table 4.

TABLE 4

| Run Identification | Run Time (hrs) | Coupon No. | Weight | Activity MicroCuries/g | Activity MicroCuries |
|---|---|---|---|---|---|
| Configuration | 16.5 | 28 | 15.987 | 5.2520E−05 | 8.3964E−04 |
| | | 15 | 16.008 | 1.4330E−05 | 2.2939E−04 |
| | | 26 | 15.986 | 1.4410E−05 | 2.3036E−04 |

Example 5

Configuration 4.

Figure 10:
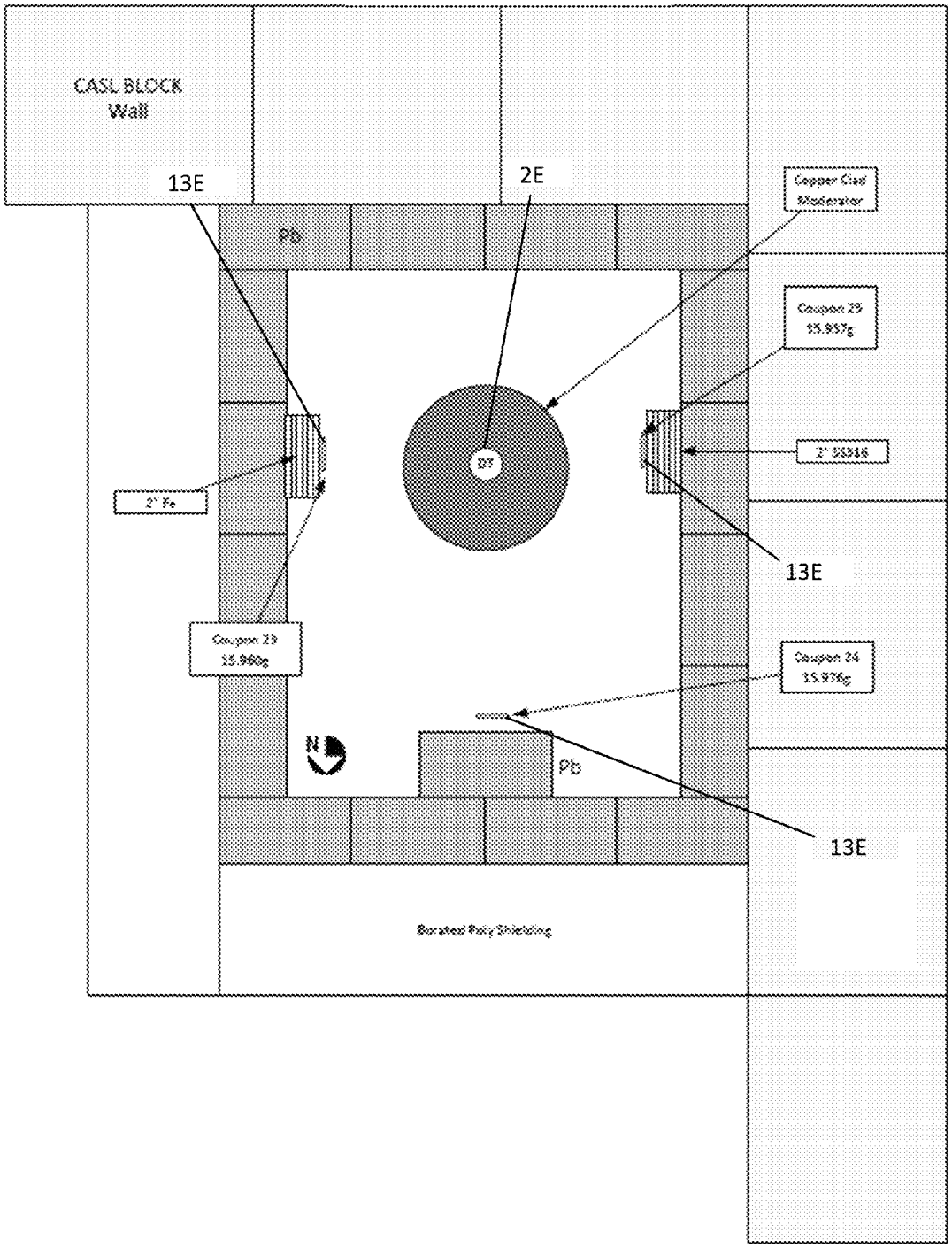
FIG. 10 is a diagram of the laboratory room during the conduction of the test described in Example 5.

The laboratory was configured as depicted in FIG. 10 using shielding of the type, thickness and orientation as indicated in the figure. The targets of the test were 2molybdenum coupons 13E (Coupon Nos. 23 and 24) each containing about 16 g of naturally occurring molybdenum. A D-T neutron generator 2E was activated for hours in the presence of the coupons. At the conclusion of the test the coupons were tested for radioactivity. The amount of radioactivity is indicative of the amount of molybdenum transformed into Tc-99m. The results are shown below in Table 5.

TABLE 5

| Run Identification | Run Time (hrs) | Coupon No. | Weight | Activity MicroCuries/g | Activity MicroCuries |
|---|---|---|---|---|---|
| Configuration | 16 | 23 | 15.961 | 1.7310E−05 | 2.7628E−04 |
| | | 24 | 15.976 | 3.5420E−05 | 5.6587E−04 |

Example 6

Configuration 5.

Figure 11:
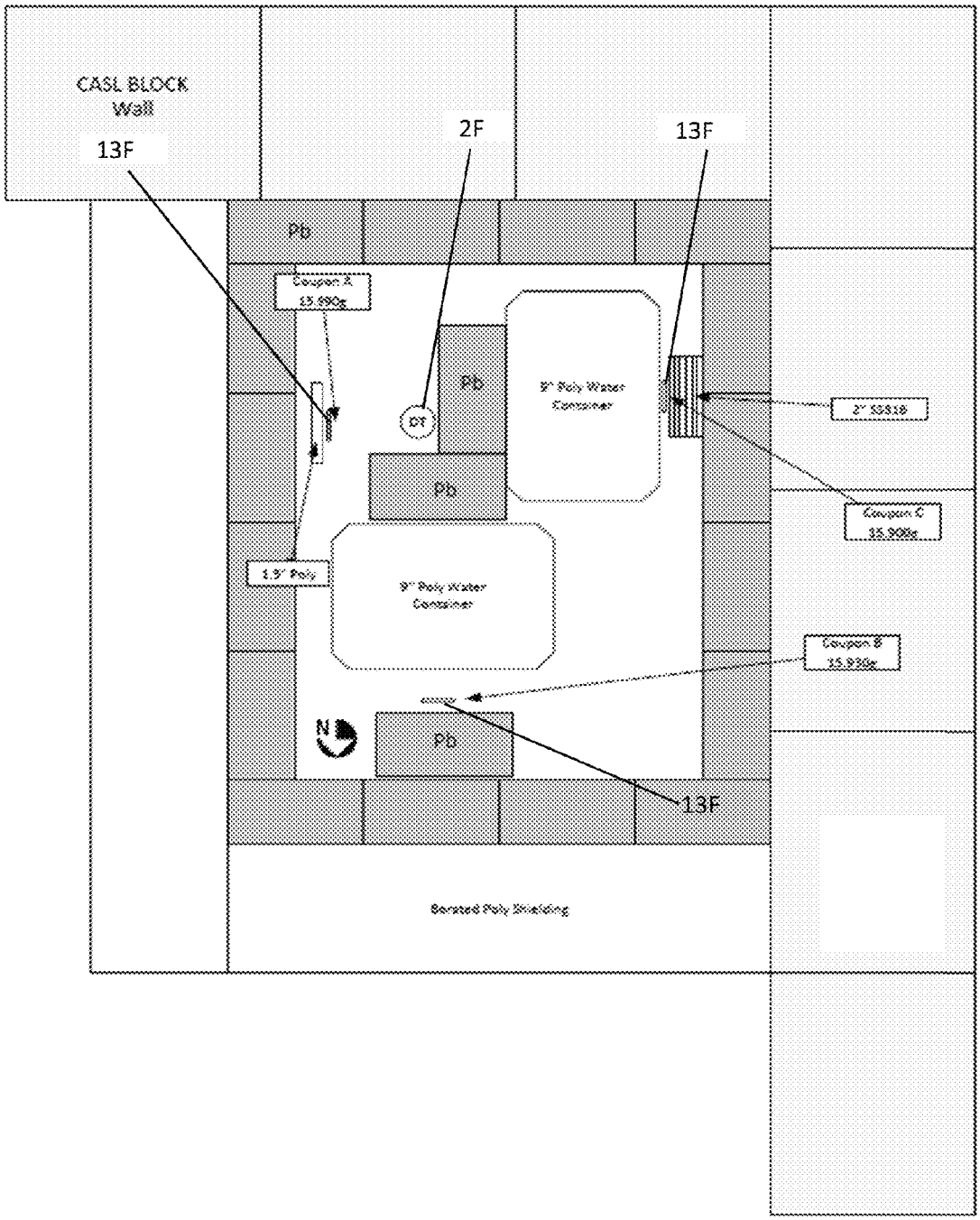
FIG. 11 is a diagram of the laboratory room during the conduction of the test described in Example 6.

The laboratory was configured as depicted in FIG. 11 using shielding of the type, thickness and orientation as indicated in the figure. The targets of the test were 3 molybdenum coupons 13F (Coupon Nos. A, B and C) each generator 2F was activated for 16 hours in the presence of the coupons. At the conclusion of the test the coupons were tested for radioactivity. The amount of radioactivity is indicative of the amount of molybdenum transformed into Tc-99m. The results are shown below in Table 6.

TABLE 6

| Run Identification | Run Time (hrs) | Coupon No. | Weight | Activity MicroCuries/g | Activity MicroCuries |
|---|---|---|---|---|---|
| Configuration | 16 | A | 15.990 | 1.3560E−04 | 2.1682E−03 |
| | | B | 15.900 | <MDA | <MDA |
| | | C | 15.930 | <MDA | <MDA |

Example 7

Configuration 6.

Figure 12:
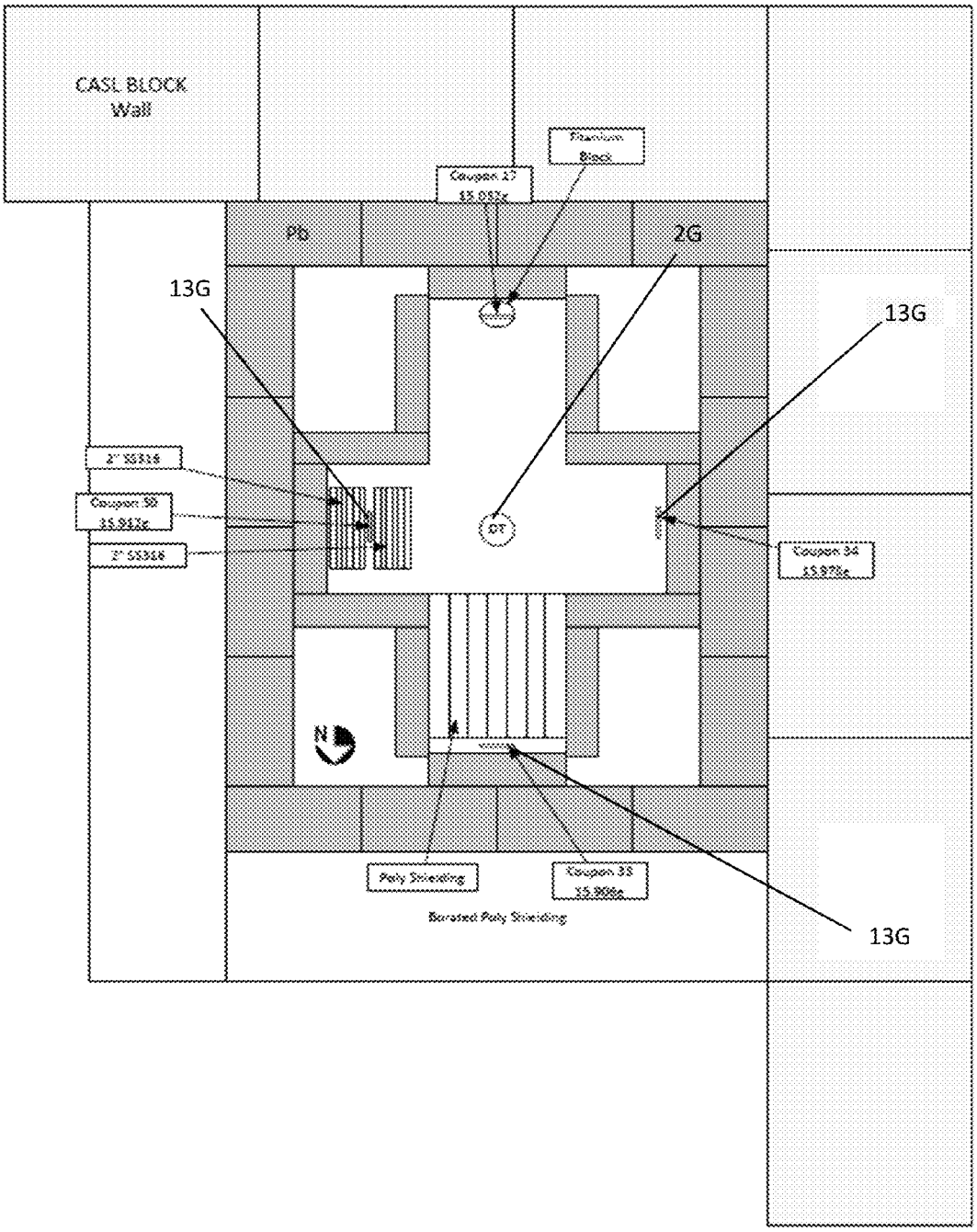
FIG. 12 is a diagram of the laboratory room during the conduction of the test described in Example 7.

The laboratory was configured as depicted in FIG. 12 using shielding of the type, thickness and orientation as indicated in the figure. The targets of the test were 3 molybdenum coupons 13G (Coupon Nos. 17, 34 and 33) each containing about 15-16 g of naturally occurring molybdenum. A D-T neutron generator 2G was activated for 16 hours in the presence of the coupons. At the conclusion of the test the coupons were tested for radioactivity. The amount of radioactivity is indicative of the amount of molybdenum transformed into Tc-99m. The results are shown below in Table 7.

TABLE 7

| Run Identification | Run Time (hrs) | Coupon No. | Weight | Activity MicroCuries/g | Activity MicroCuries |
|---|---|---|---|---|---|
| Configuration | 16 | 17 | 15.032 | 5.5110E−05 | 8.2841E−04 |
| | | 34 | 15.978 | <MDA | <MDA |
| | | 33 | 15.921 | 3.3630E−05 | 5.3542E−04 |

Example 8

Configuration 7.

Figure 13:
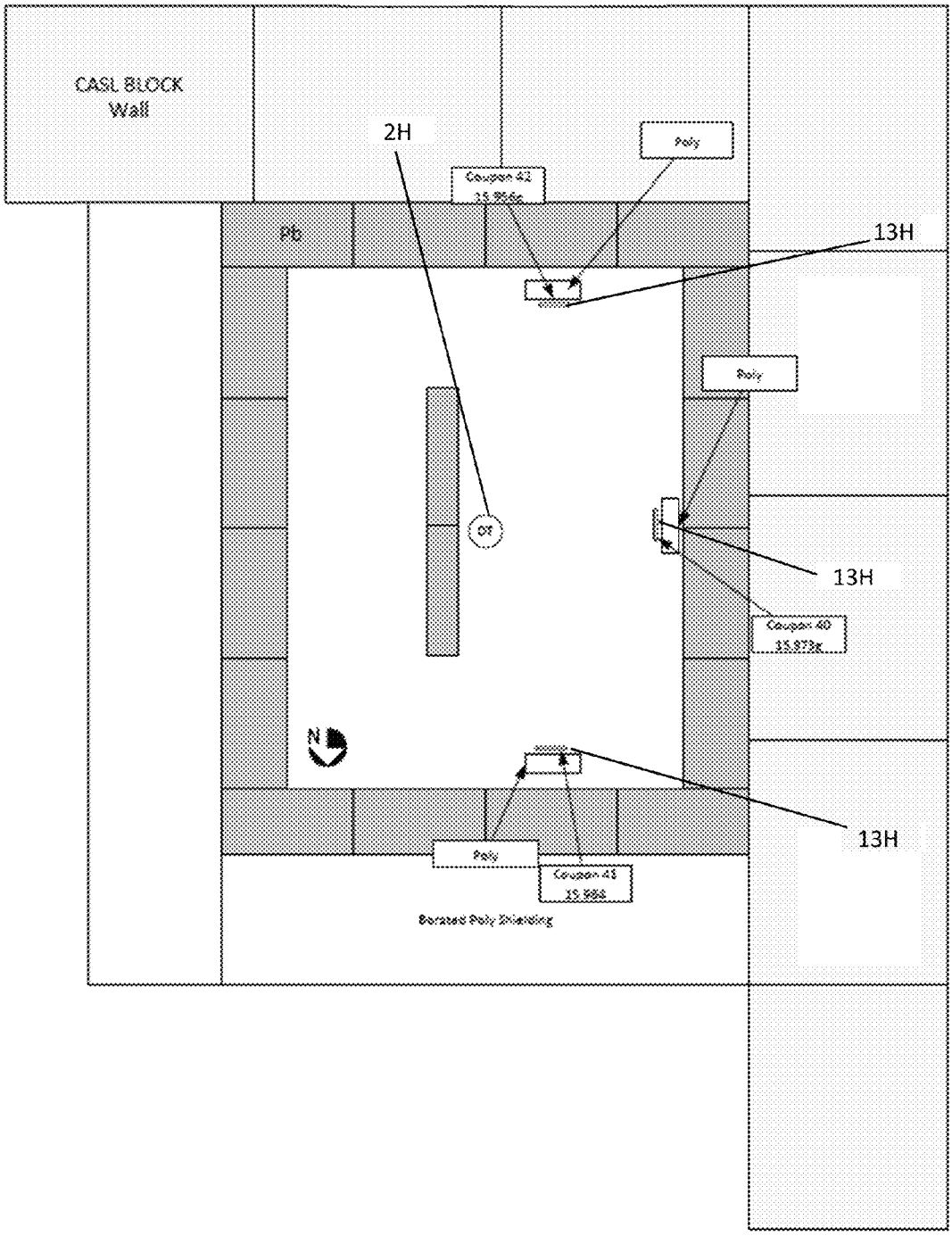
FIG. 13 is a diagram of the laboratory room during the conduction of the test described in Example 8.

The laboratory was configured as depicted in FIG. 13 using shielding of the type, thickness and orientation as indicated in the figure. The targets of the test were 3 molybdenum coupons 13H (Coupon Nos. 40, 41 and 42) each containing about 16 g of naturally occurring molybdenum. A D-T neutron generator 2H was activated for 16 hours in the presence of the coupons. At the conclusion of the test the coupons were tested for radioactivity. The amount of radioactivity is indicative of the amount of molybdenum transformed into Tc-99m. The results are shown below in Table 8.

TABLE 8

| Run Identification | Run Time (hrs) | Coupon No. | Weight | Activity MicroCuries/g | Activity MicroCuries |
|---|---|---|---|---|---|
| Configuration | 16 | 40 | 15.973 | 5.8560E−05 | 9.3538E−04 |
| | | 41 | 15.964 | 2.5890E−05 | 4.1331E−04 |
| | | 42 | 15.956 | 2.7810E−05 | 4.4374E−04 |

Example 9

Configuration 7.

Figure 14:
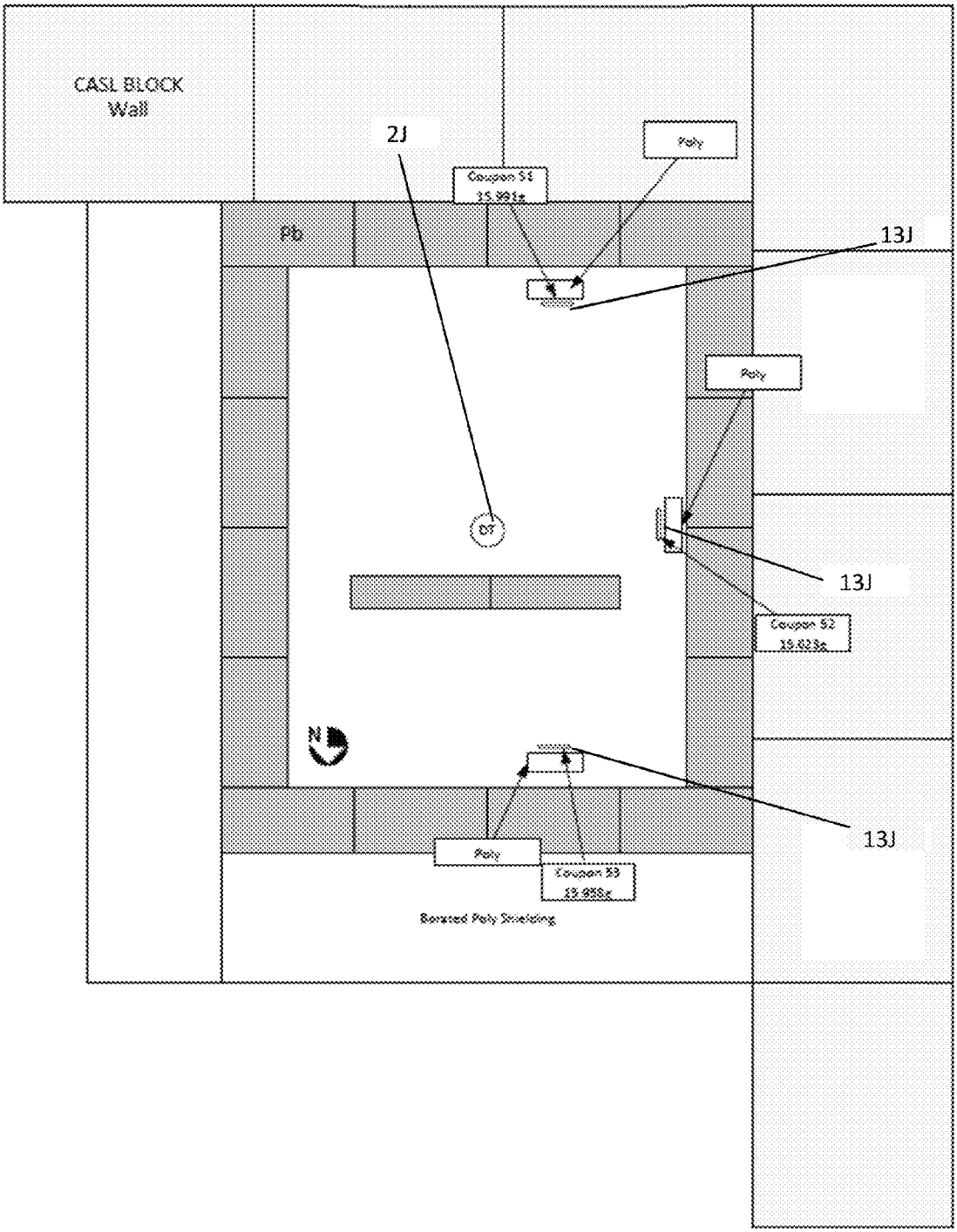
FIG. 14 is a diagram of the laboratory room during the conduction of the test described in Example 9.

The laboratory was configured as depicted in FIG. 14 using shielding of the type, thickness and orientation as indicated in the figure. The targets of the test were 3 molybdenum coupons 13J (Coupon Nos. 51, 52 and 53) each containing about 16 g of naturally occurring molybdenum. A D-T neutron generator 2J was activated for 14 hours in the presence of the coupons. At the conclusion of the test the coupons were tested for radioactivity. The amount of radioactivity is indicative of the amount of molybdenum transformed into Tc-99m. The results are shown below in Table 9.

TABLE 9

| Run Identification | Run Time (hrs) | Coupon No. | Weight | Activity MicroCuries/g | Activity MicroCuries |
|---|---|---|---|---|---|
| Configuration | 14 | 51 | 15.991 | 2.2250E−05 | 3.5580E−04 |
| | | 52 | 16.023 | 1.6620E−05 | 2.6630E−04 |
| | | 53 | 15.958 | <MDA | <MDA |

Example 10

Configuration 9.

Figure 15:
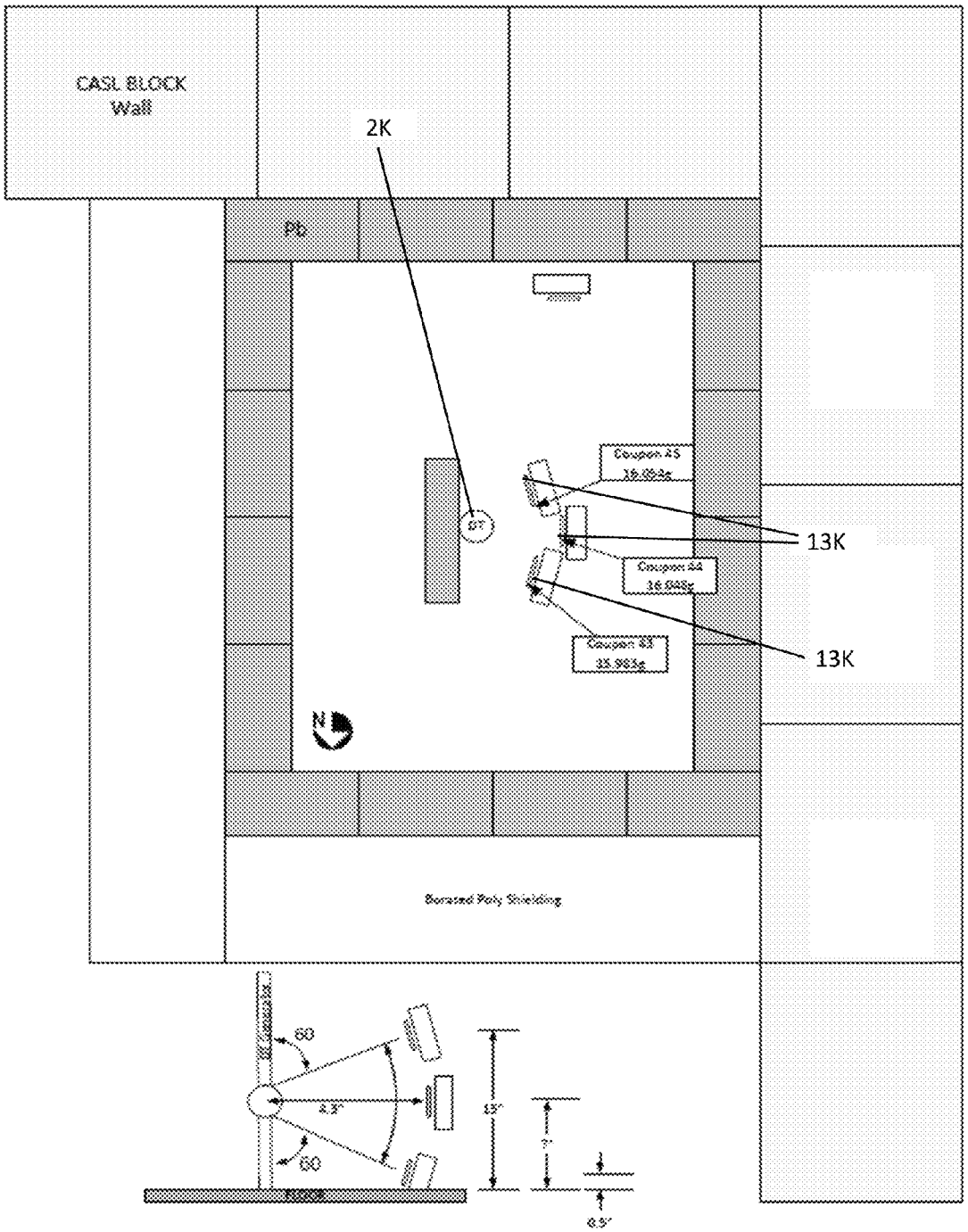
FIG. 15 is a diagram of the laboratory room during the conduction of the test described in Example 10.

The laboratory was configured as depicted in FIG. 15 using shielding of the type, thickness and orientation as indicated in the figure. The targets of the test were 3 molybdenum coupons 13K (Coupon Nos. 43, 44 and 45) each containing about 16 g of naturally occurring molybdenum. A D-T neutron generator 2K was activated for 16 hours in the presence of the coupons. At the conclusion of the test the coupons were tested for radioactivity. The amount of radioactivity is indicative of the amount of molybdenum transformed into Tc-99m. The results are shown below in Table 10.

TABLE 10

| Run Identification | Run Time (hrs) | Coupon No. | Weight | Activity MicroCuries/g | Activity MicroCuries |
|---|---|---|---|---|---|
| Configuration | 16 | 43 | 15.983 | 8.9200E−05 | 1.4257E−03 |
| | | 44 | 16.048 | 5.5580E−05 | 8.9195E−04 |
| | | 54 | 16.054 | 6.0350E−05 | 9.6886E−04 |

Example 11

Configuration 10.

Figure 16:
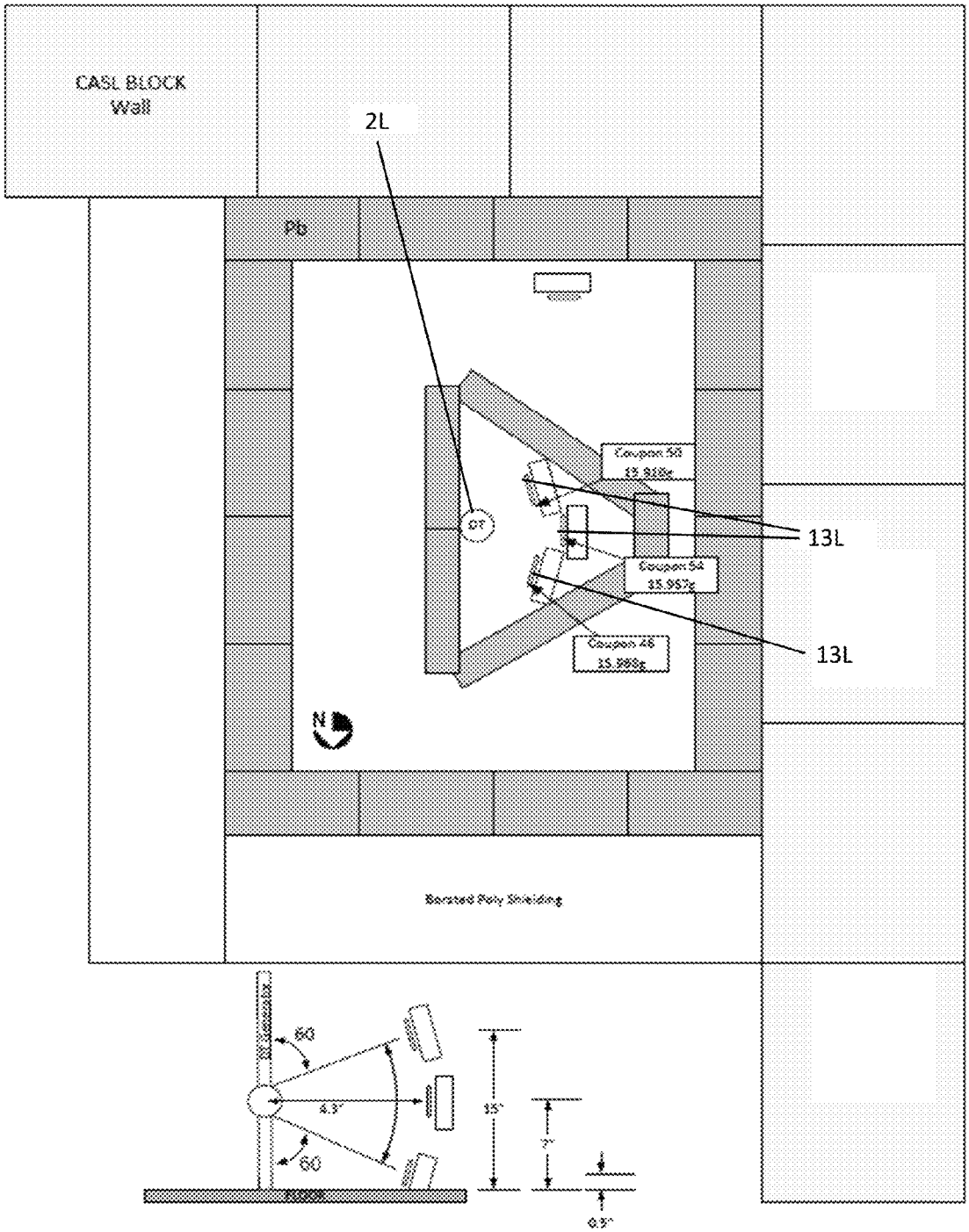
FIG. 16 is a diagram of the laboratory room during the conduction of the test described in Example 11.

The laboratory was configured as depicted in FIG. 16 using shielding of the type, thickness and orientation as indicated in the figure. The targets of the test were 3 molybdenum coupons 13L (Coupon Nos. 46. 54 and 50) each containing about 16 g of naturally occurring molybdenum. A D-T neutron generator 2L was activated for 16 hours in the presence of the coupons. At the conclusion of the test the coupons were tested for radioactivity. The amount of radioactivity is indicative of the amount of molybdenum transformed into Tc-99m. The results are shown below in Table 11.

TABLE 11

| Run Identification | Run Time (hrs) | Coupon No. | Weight | Activity MicroCuries/g | Activity MicroCuries |
|---|---|---|---|---|---|
| Configuration | 16 | 46 | 15.968 | 8.6860E−05 | 1.3870E−03 |
| | | 54 | 15.957 | 2.4300E−04 | 3.8776E−03 |
| | | 50 | 15.91 | 8.4070E−05 | 1.3376E−03 |

Example 12

Configuration 11.

Figure 17:
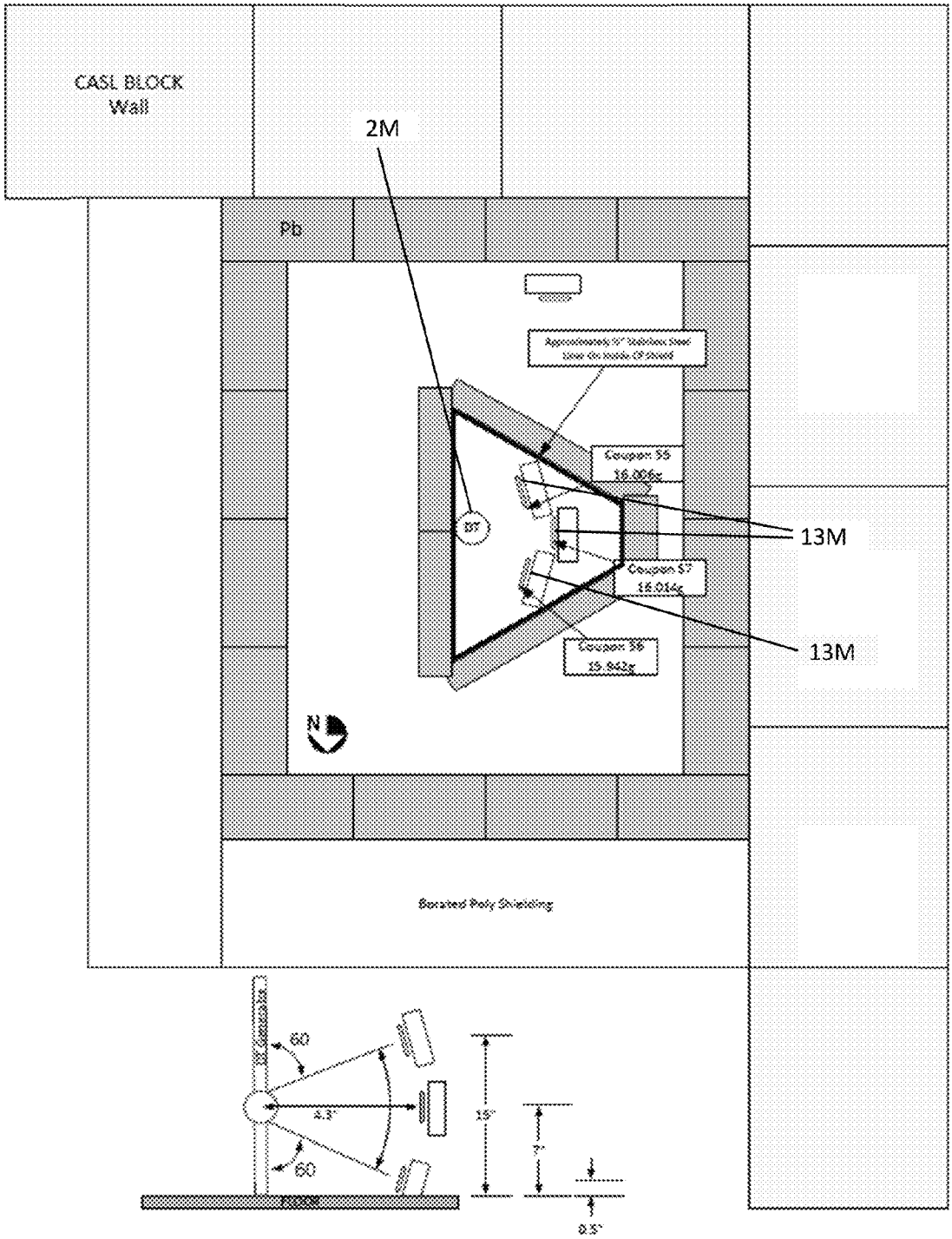
FIG. 17 is a diagram of the laboratory room during the conduction of the test described in Example 12.

The laboratory was configured as depicted in FIG. 17 using shielding of the type, thickness and orientation as indicated in the figure. The targets of the test were 3 molybdenum coupons 13M (Coupon Nos. 55, 57 and 56) each containing about 16 g of naturally occurring molybdenum. A D-T neutron generator 2M was activated for 16 hours in the presence of the coupons. At the conclusion of the test the coupons were tested for radioactivity. The amount of radioactivity is indicative of the amount of molybdenum transformed into Tc-99m. The results are shown below in Table 12.

TABLE 12

| Run Identification | Run Time (hrs) | Coupon No. | Weight | Activity MicroCuries/g | Activity MicroCuries |
|---|---|---|---|---|---|
| Configuration | 16 | 55 | 16.006 | 8.1550E−05 | 1.3053E−03 |
| | | 57 | 16.014 | 2.0280E−04 | 3.2476E−03 |
| | | 56 | 15.942 | 5.2230E−05 | 8.32.65E−03 |

Example 13

Configuration 12

Figure 18:
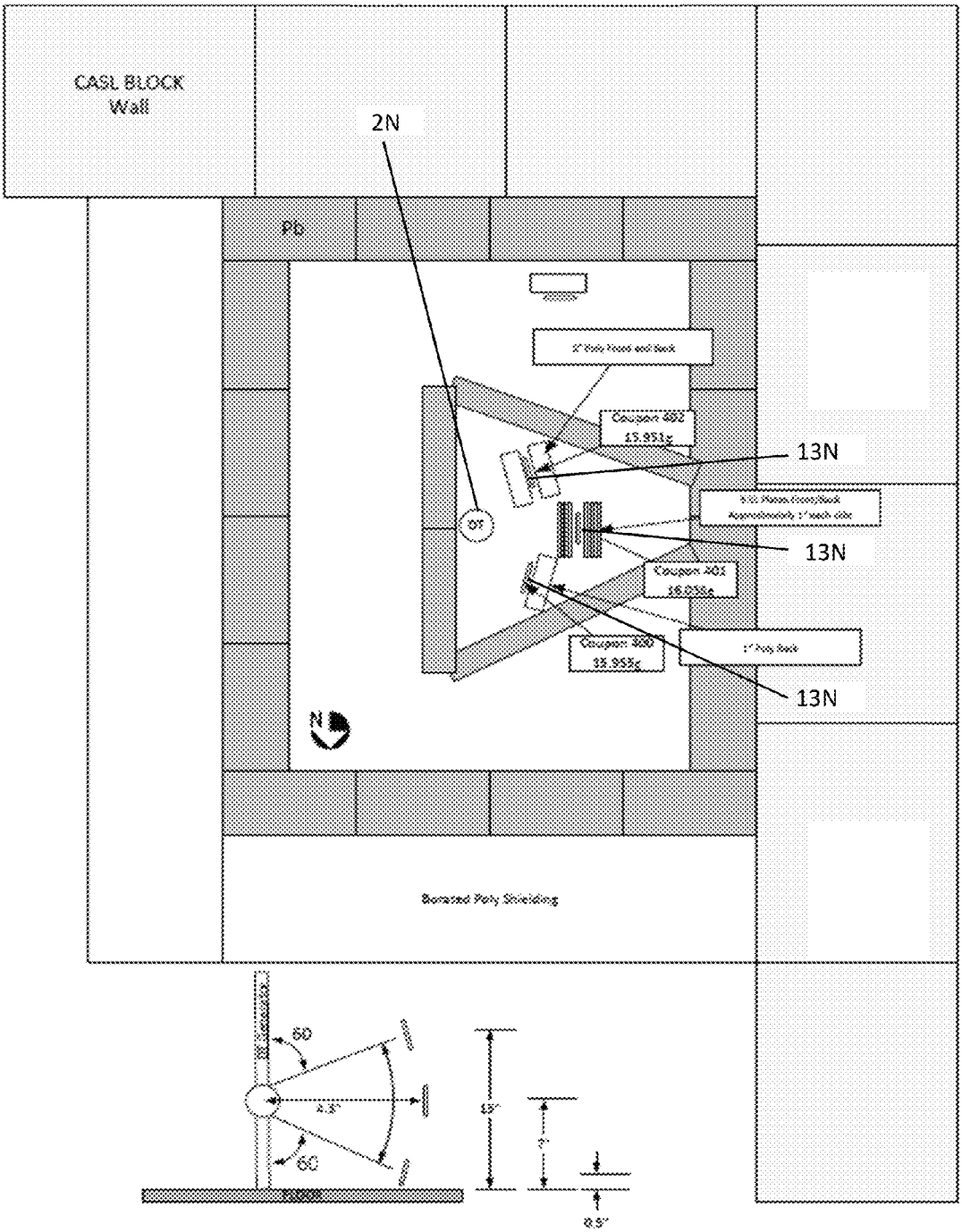
FIG. 18 is a diagram of the laboratory room during the conduction of the test described in Example 13.

The laboratory was configured as depicted in FIG. 18 using shielding of the type, thickness and orientation as indicated in the figure. The targets of the test were 3 molybdenum coupons 13N (Coupon Nos. 400, 401, 402) each containing about 16 g of naturally occurring molybdenum. A D-T neutron generator 2N was activated for 16 hours in the presence of the coupons. At the conclusion of the test the coupons were tested for radioactivity. The amount of radioactivity is indicative of the amount of molybdenum transformed into Tc-99m. The results are shown below in Table 13.

TABLE 13

| Run Identification | Run Time (hrs) | Coupon No. | Weight | Activity MicroCuries/g | Activity MicroCuries |
|---|---|---|---|---|---|
| Configuration | 16 | 400 | 15.955 | 8.2770E−05 | 1.3206E−03 |
| | | 401 | 16.038 | 7.7090E−05 | 1.2364E−03 |
| | | 402 | 15.951 | 5.5380E−05 | 8.8337E−04 |

Example 14

Configuration 13.

Figure 19:
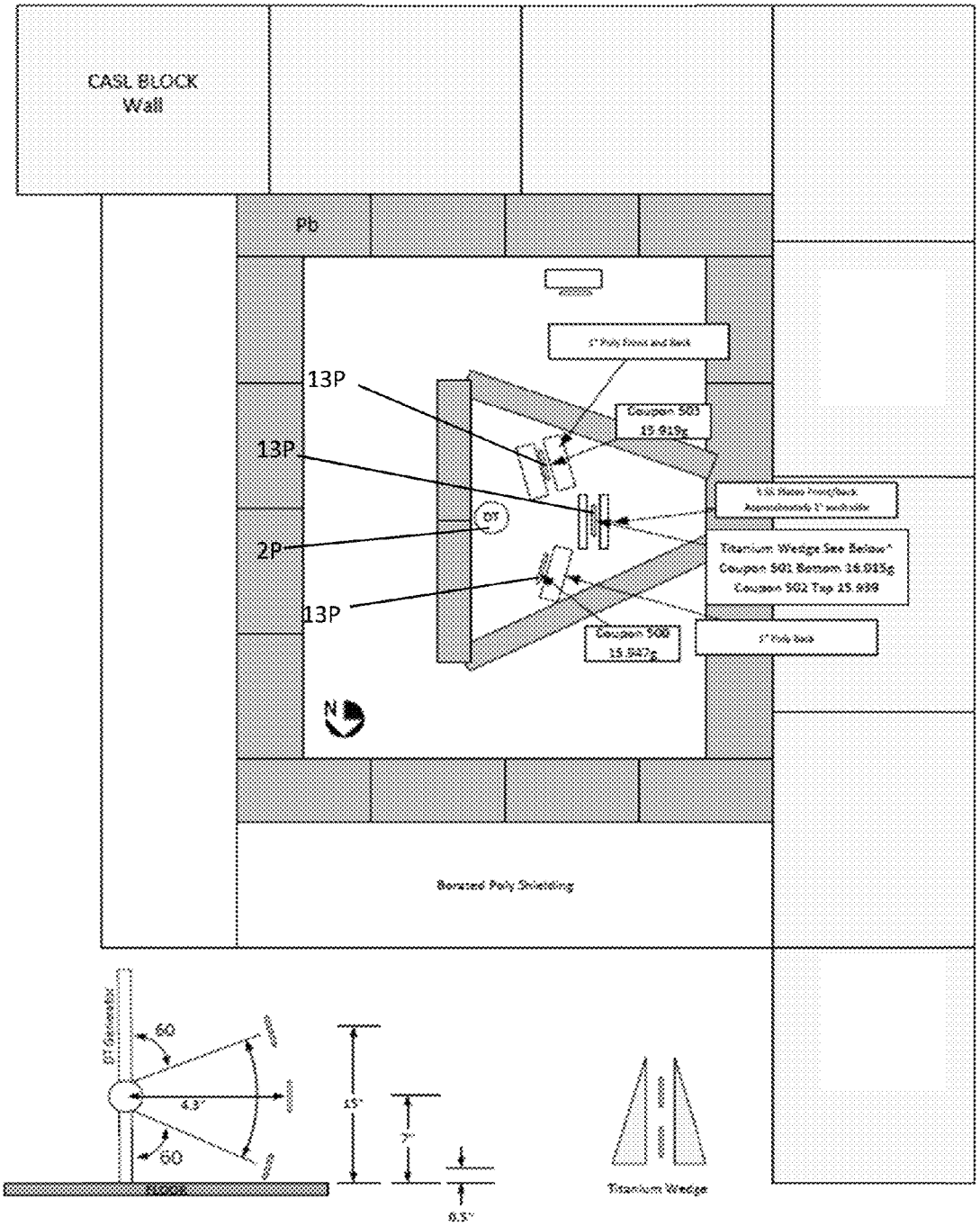
FIG. 19 is a diagram of the laboratory room during the conduction of the test described in Example 14.

The laboratory was configured as depicted in FIG. 19 using shielding of the type, thickness and orientation as indicated in the figure. The targets of the test were 4 molybdenum coupons 13P (Coupon Nos. 500, 501, 502, 503) each containing about 16 g of naturally occurring molybdenum. A D-T neutron generator 2P was activated for 18 hours in the presence of the coupons. At the conclusion of the test the coupons were tested for radioactivity. The amount of radioactivity is indicative of the amount of molybdenum transformed into Tc-99m. The results are shown below in Table 14.

TABLE 14

| Run Identification | Run Time (hrs) | Coupon No. | Weight | Activity MicroCuries/g | Activity MicroCuries |
|---|---|---|---|---|---|
| Configuration | 18 | 500 | 15.947 | 3.2770E−05 | 5.2258E−04 |
| | | 501 | 16.015 | 1.2700E−04 | 2.0339E−03 |
| | | 502 | 15.939 | 1.1790E−04 | 1.8792E−03 |
| | | 503 | 15.919 | 3.0500E−05 | 4.8553E−04 |

Example 15

Configuration 14.

Figure 20:
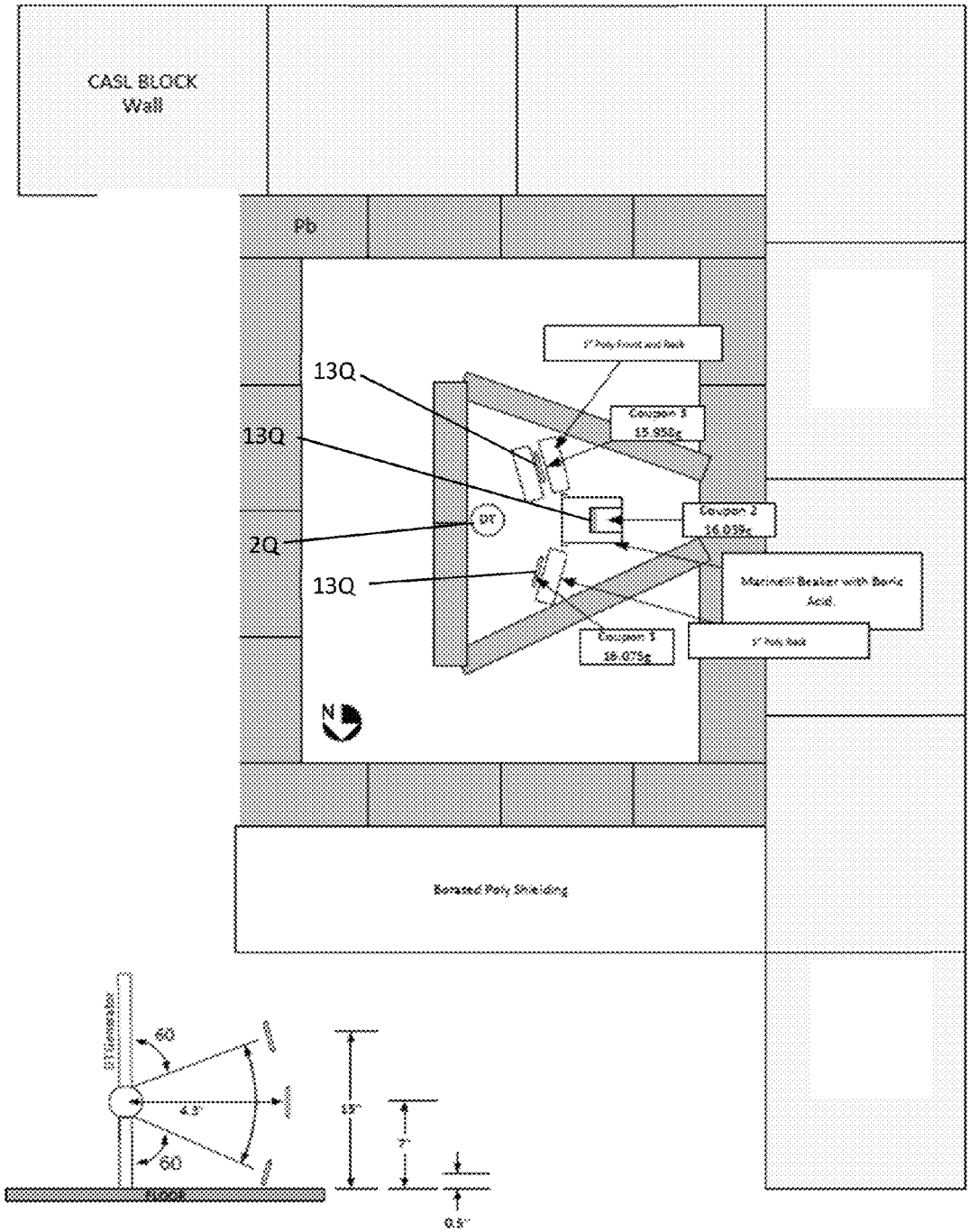
FIG. 20 is a diagram of the laboratory room during the conduction of the test described in Example 15.

The laboratory was configured as depicted in FIG. 20 using shielding of the type, thickness and orientation as indicated in the figure. The targets of the test were 3 molybdenum coupons 13Q (Coupon Nos. 1, 2 and 3) each containing about 16 g of naturally occurring molybdenum. A D-T neutron generator 2Q was activated for hours in the presence of the coupons. At the conclusion of the test the coupons were tested for radioactivity. The amount of radioactivity is indicative of the amount of molybdenum transformed into Tc-99m. The results are shown below in Table 15.

TABLE 15

| Run Identification | Run Time (hrs) | Coupon No. | Weight | Activity MicroCuries/g | Activity MicroCuries |
|---|---|---|---|---|---|
| Configuration | 16 | 1 | 16.075 | 6.6170E−05 | 1.0637E−03 |
| | | 2 | 16.039 | 6.8510E−05 | 1.0988E−03 |
| | | 3 | 15.958 | 3.7410E−05 | 5.9699E−04 |

Example 16

Configuration 15.

Figure 21:
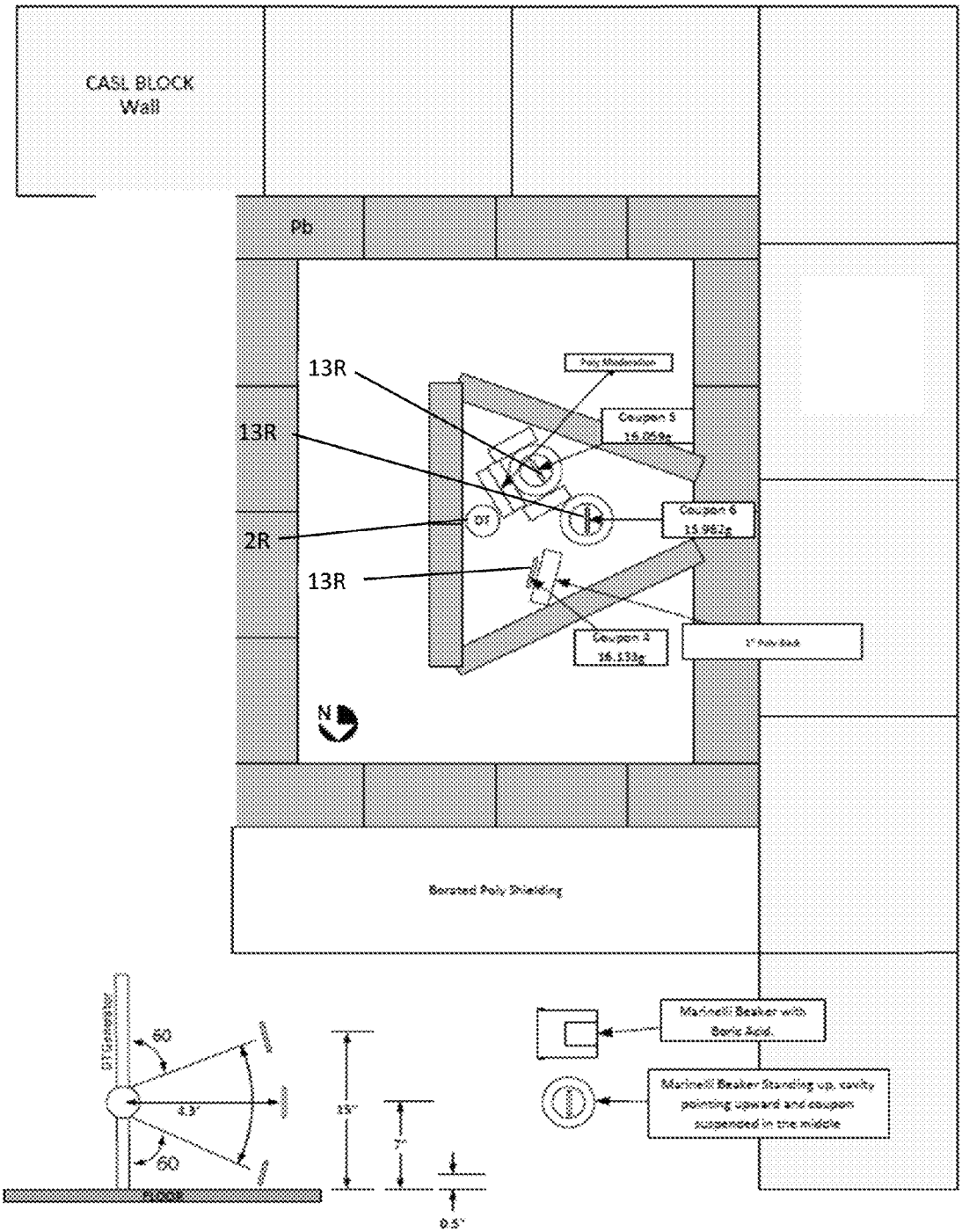
FIG. 21 is a diagram of the laboratory room during the conduction of the test described in Example 16.

The laboratory was configured as depicted in FIG. 21 using shielding of the type, thickness and orientation as indicated in the figure. The targets of the test were 3 molybdenum coupons 13R (Coupon Nos. 4, 5 and 6) each containing about 16 g of naturally occurring molybdenum. A D-T neutron generator 2R was activated for 16 hours in the presence of the coupons. At the conclusion of the test the coupons were tested for radioactivity. The amount of radioactivity is indicative of the amount of molybdenum transformed into Tc-99m. The results are shown below in Table 16.

TABLE 16

| Run Identification | Run Time (hrs) | Coupon No. | Weight | Activity MicroCuries/g | Activity MicroCuries |
|---|---|---|---|---|---|
| Configuration | 16 | 4 | 16.133 | 5.3780E−05 | 8.6763E−04 |
| | | 5 | 16.059 | 1.4720E−05 | 2.3639E−04 |
| | | 6 | 15.962 | 6.6720E−05 | 1.0650E−03 |

Example 17

Configuration 16.

Figure 22:
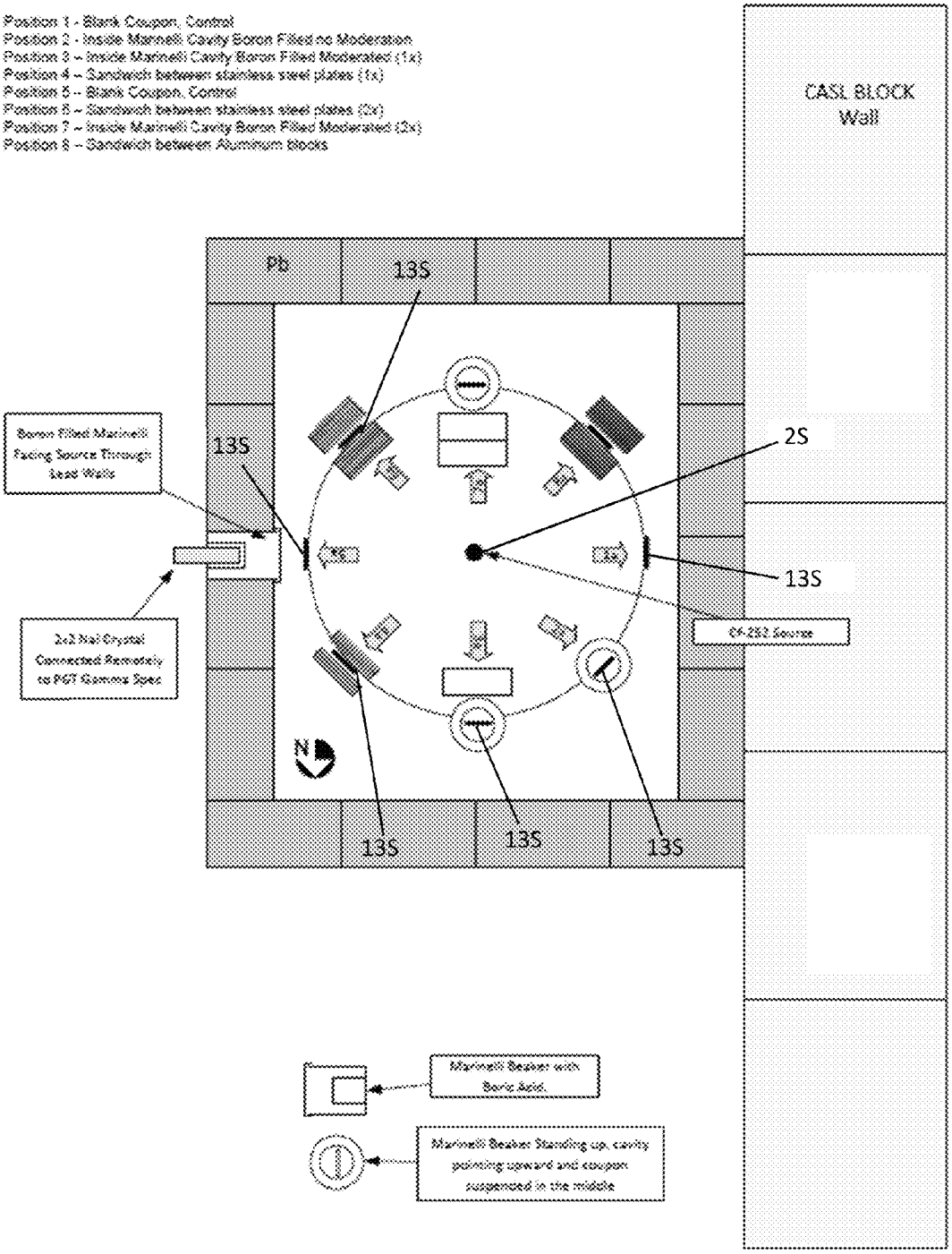
FIG. 22 is a diagram of the laboratory room during the conduction of the test described in Example 17.

The laboratory was configured as depicted in FIG. 22 using shielding of the type, thickness and orientation as indicated in the figure. The targets of the test were 6 molybdenum coupons 13S (Coupon Nos. 1*a*, 2*a*, 3*a*, 4*a*, 5*a* and 6*a*) each containing about 16 g of naturally occurring molybdenum. A Cf 252 source 2S was left unshielded for 66 hours in the presence of the coupons. At the conclusion of the test the coupons were tested for radioactivity. The amount of radioactivity is indicative of the amount of molybdenum transformed into Tc-99m. The results are shown below in Table 17.

TABLE 17

| Run Identification | Run Time (hrs) | Coupon No. | Weight | Activity MicroCuries/g | Activity MicroCuries |
|---|---|---|---|---|---|
| Configuration | 66 | 1a | 15.973 | 1.8360E−06 | 2.9326E−05 |
| | | 2a | 15.987 | 3.8240E−06 | 6.1134E−05 |
| | | 3a | 15.964 | 6.7080E−06 | 1.0709E−04 |
| | | 4a | 15.886 | 1.1500E−05 | 1.8269E−04 |
| | | 5a | 16.061 | 4.5230E−06 | 7.2644E−05 |
| | | 6a | 15.969 | 8.9160E−06 | 1.4238E−04 |

Although features and elements are described above in particular combinations, each feature or element may be used alone without the other features and elements or in various combinations with or without other features and elements.

What is claimed is:

1. A method of producing Mo-99 from a Mo-100 target, the method comprising:

providing a neutron output with an average energy of between about 6MeV and about 14.1 MeV;

moderating with a moderator the neutron output to produce a moderated neutron output with an average energy range of between about 6 MeV and about 14 MeV;

exposing a copper target to the moderated neutron output to produce gamma rays of greater than 8 MeV, and exposing the Mo-100 target to the gamma rays of greater than 8 MeV to produce Mo-99 with a yield of approximately $7.7\times10^{-6}$ microcuries per gram to $2.4\times10^{-3}$ microcuries per gram.

2. The method of claim 1, further comprising collecting the Mo99 produced and transferring the Mo99 to a Technetium-99m generator.

3. The method of claim 1, wherein the neutrons are produced from a deuterium-tritium (D-T) Neutron generator.

4. The method of claim 1, wherein the moderator comprises polyethylene.

5. The method of claim 1, wherein the molybdenum target comprise a coupon.

6. The method of claim 1, wherein the molybdenum target comprises powdered molybdenum disposed in a fluid.

* * * * *